US008215634B2

(12) United States Patent
Nireki

(10) Patent No.: US 8,215,634 B2
(45) Date of Patent: Jul. 10, 2012

(54) PAPER SHEET PROCESSING DEVICE

(75) Inventor: Takao Nireki, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 118 days.

(21) Appl. No.: 12/744,787

(22) PCT Filed: Nov. 7, 2008

(86) PCT No.: PCT/JP2008/070349

§ 371 (c)(1),
(2), (4) Date: May 26, 2010

(87) PCT Pub. No.: WO2009/069452

PCT Pub. Date: Jun. 4, 2009

(65) Prior Publication Data

US 2010/0301542 A1 Dec. 2, 2010

(30) Foreign Application Priority Data

Nov. 26, 2007 (JP) ..... 2007-304185

(51) Int. Cl.
*B65H 1/08* (2006.01)

(52) U.S. Cl. ..... 271/147; 271/162; 194/350

(58) Field of Classification Search ..... 271/145, 271/147, 162, 181; 194/350
See application file for complete search history.

(56) References Cited

U.S. PATENT DOCUMENTS 5,411,249 A 5/1995 Zouzoulas

FOREIGN PATENT DOCUMENTS

| | | |
|---|---|---|
| JP | 6 44439 | 2/1994 |
| JP | 8 202923 | 8/1996 |
| JP | 9 16829 | 1/1997 |

*Primary Examiner* — Michael McCullough
(74) *Attorney, Agent, or Firm* — Edwards Wildman Palmer LLP

(57) ABSTRACT

Provided is a paper sheet processing device having a paper currency receiving section which can be attached to and detached from a frame and can receive a paper currency, the pressing plate which is, in the paper currency receiving section, moved between a pressing position for pressing a paper currency and an initial position for permitting conveyance of the paper currency into the paper currency receiving section, a detection member which can move as the pressing plate moves, a sensor which detects movement of the detection member by detecting movement of the pressing plate to the pressing position, and a movement mechanism which, when the paper currency receiving section is detached from the frame, moves the detection member so that the detection member can be detected by the sensor.

6 Claims, 21 Drawing Sheets

PAPER SHEET PROCESSING DEVICE

FIELD OF THE INVENTION

The present invention relates to a paper sheet processing apparatus (or device) comprising a paper sheet housing part in which bills, cards, coupon tickets, and so on (hereafter collectively referred to as "paper sheet") having been validated are stacked one after another after authenticity of the paper sheets.

BACKGROUND ART

In general, a bill processing apparatus, which is one of the embodiments of the paper sheet processing apparatus, is incorporated into a service device such as a game medium rental machine installed in a game hall, a vending machine or a ticket-vending machine installed in a public space, or the like which identifies the validity of a bill inserted from a bill insertion slot by a user and provides various types of products and services in accordance with a value of the bill having been judged as valid. Such a bill processing apparatus comprises a bill conveyance mechanism that conveys a bill inserted into a bill insertion slot, a bill identification part that conducts validity judgment (or also referred to as authenticity judgment) whether the bill to be conveyed is valid or not, and a bill housing part (may also be referred to as a safe) that contains bills having been validated as the bills are stacked sequentially after judging authenticity of the bills.

The bill housing part comprises a placing plate on which bills having been judged as valid are stacked one after another, a presser plate that presses the bills conveyed to and positioned on the placing plate onto a housing position (pressing position), and a driving mechanism that drives the pressing plate to reciprocate toward the placing plate. The bill housing part is configured to be mountable to and demountable from the main body of the bill processing apparatus because it is necessary to replace it with an empty bill housing part when it is filled with the bills stacked on the placing plate.

Such a bill processing apparatus is configured to detect the mounting of the bill housing part (that the bill housing part is mounted accurately at a predetermined position), and to detect a position of the presser plate driven via the driving mechanism as disclosed in Patent Document 1, for example. In detail, at least one movable member which is movable according to the respective movements of the bill housing part and the presser plate is provided, and a movement of the movable member is detected by a plurality of detecting members (optical sensors or the like), whereby the mounting of the bill housing part onto the main body of the bill processing apparatus and a position of the presser plate are detected.

[Patent reference 1] Japanese patent publication No. 3765850.

DISCLOSURE OF THE INVENTION

Problem to be Solved by the Invention

Under the above-mentioned background, in the present invention, a paper sheet processing apparatus may be provided, which has a simplified structure so as to be capable of inexpensively detecting the presence or absence of mounting and demounting of a paper sheet housing part and the position of the presser plate.

Means to Solve the Problem

In the present invention, a paper sheet processing apparatus may be provided, which comprises: a paper sheet housing part being capable of housing a paper sheet and being mountable to and demountable from a frame; a presser plate to be moved in the paper sheet housing part between a pressing position where the paper sheet is pushed and a home position where the paper sheet is allowed to be conveyed inside the paper sheet housing part; a detecting member being movable in accordance with a movement of the presser plate; a sensor to detect that the detecting member is moved in accordance with the movement of the presser plate to the pressing position; and a moving mechanism to move the detecting member that becomes detectable by the sensor when the paper sheet housing part is demounted from the frame. Further features of the present invention, its nature, and various advantages will be more apparent from the accompanying drawings and the following description of the preferred embodiment.

DESCRIPTION OF NOTATIONS

Figure 1:
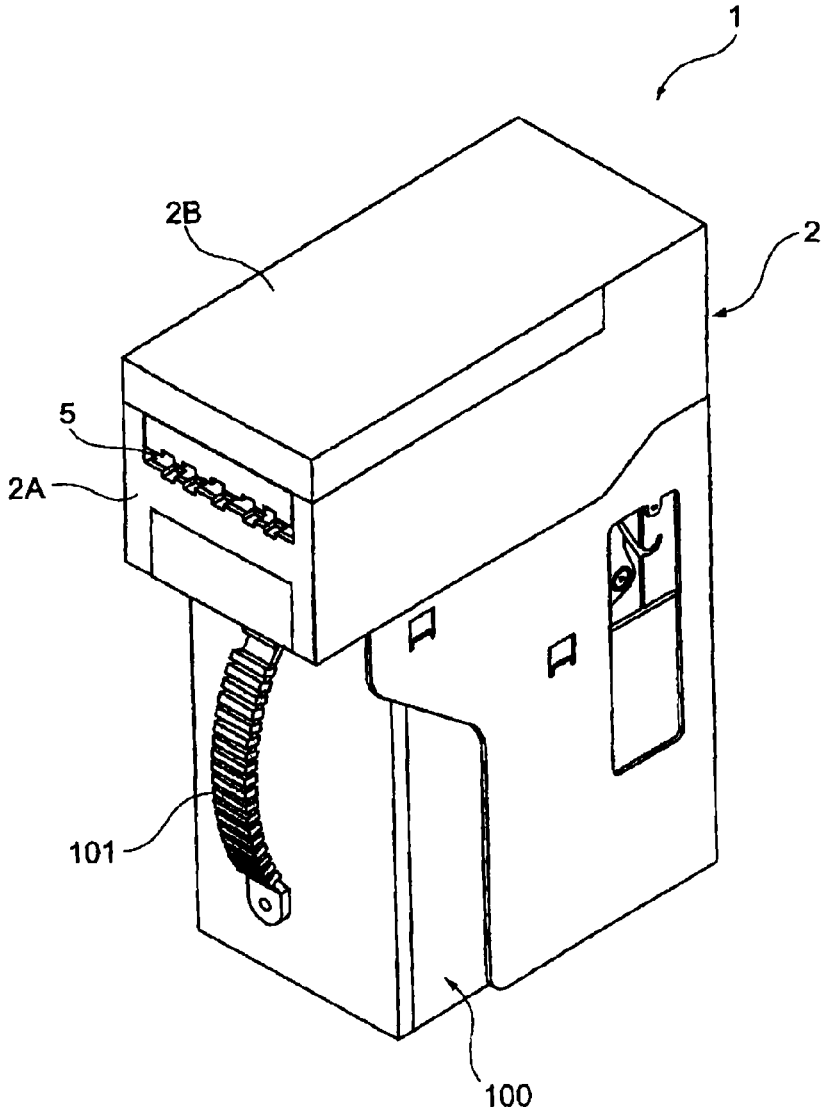
FIG. 1 is a perspective view showing an entire structure to illustrate a configuration of a bill processing apparatus of this embodiment.

1 bill processing apparatus
2 apparatus main body
2A frame
3 bill traveling route
5 bill insertion slot
6 bill conveyance mechanism
8 bill reading means
10 skew correction mechanism
13, 20, 40 motor
23 detection means
100 bill housing part
103 receiving port
105 placing plate
108 press standby part
115 presser plate
120 presser plate driving mechanism
122 movable member
122A rack
124A pinion
170 detecting member
172 sensor
175A cam member
175 cam
176 cam follower
180 moving mechanism
200 control means

BEST MODE FOR CARRYING OUT THE INVENTION

Figure 2:
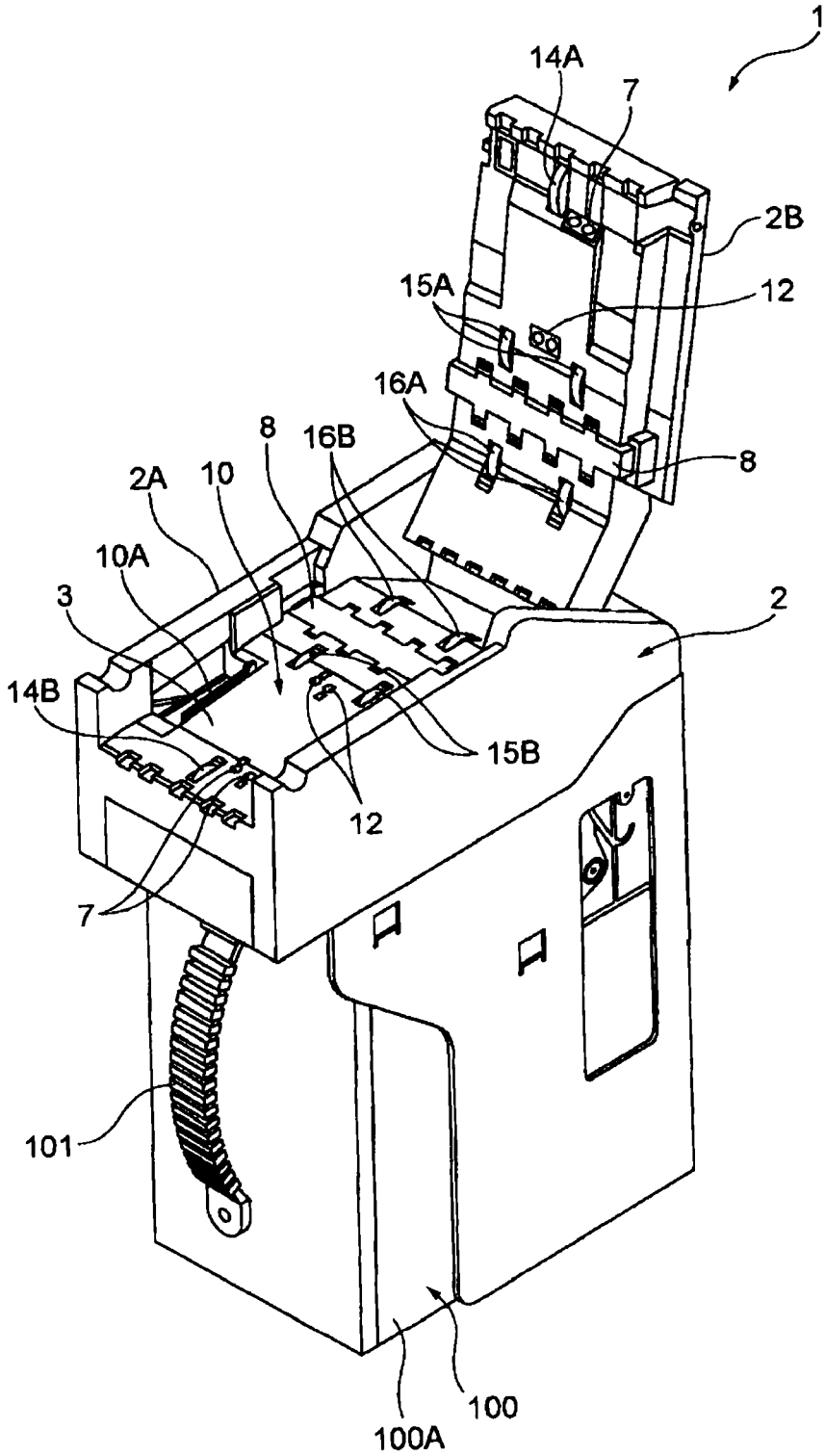
FIG. 2 is a perspective view showing the bill processing apparatus in a state where an open/close member is opened for a main body frame of an apparatus main body.
Figure 3:
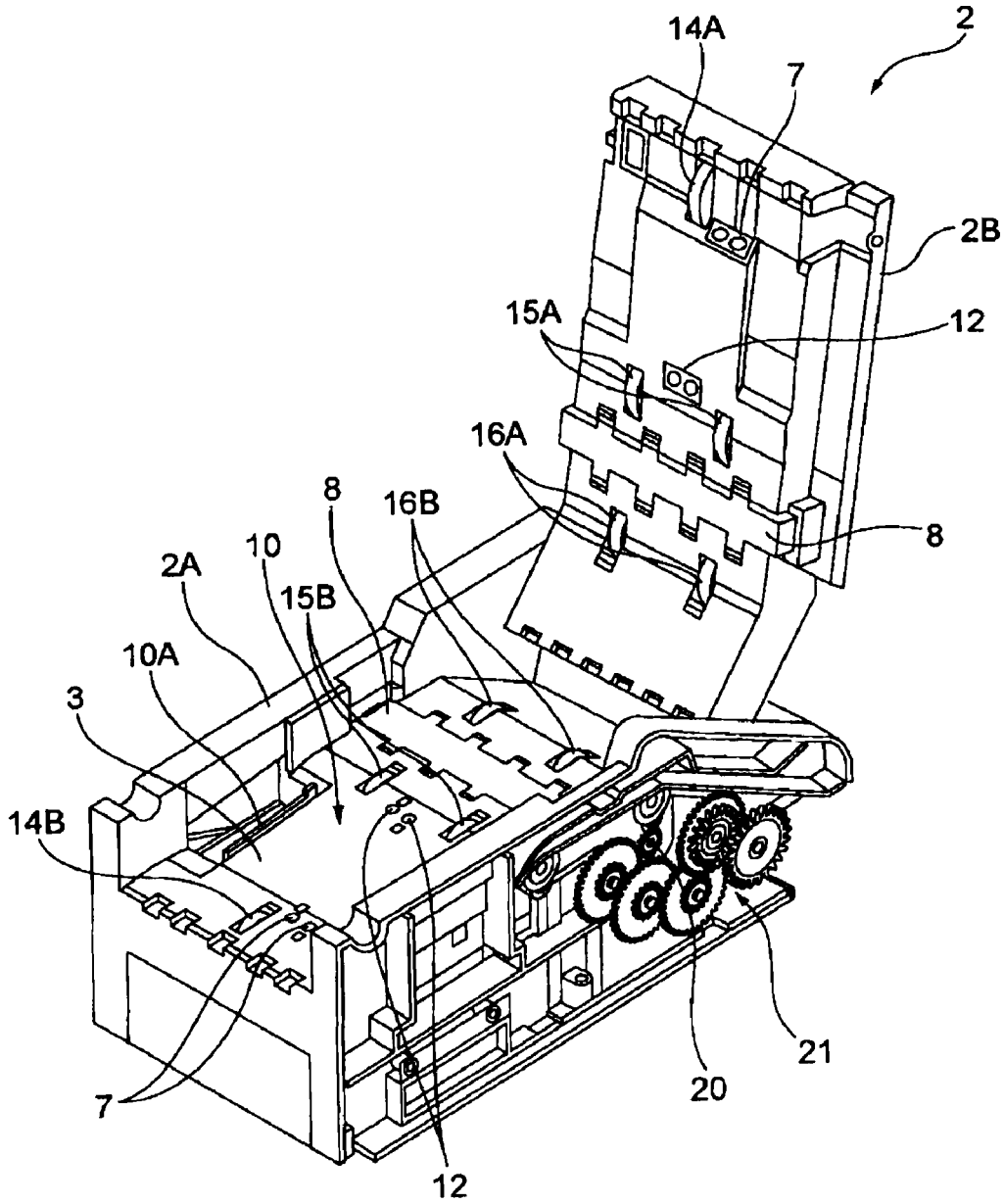
FIG. 3 is a perspective view showing a configuration of a power transmission part of the apparatus main body.
Figure 4:
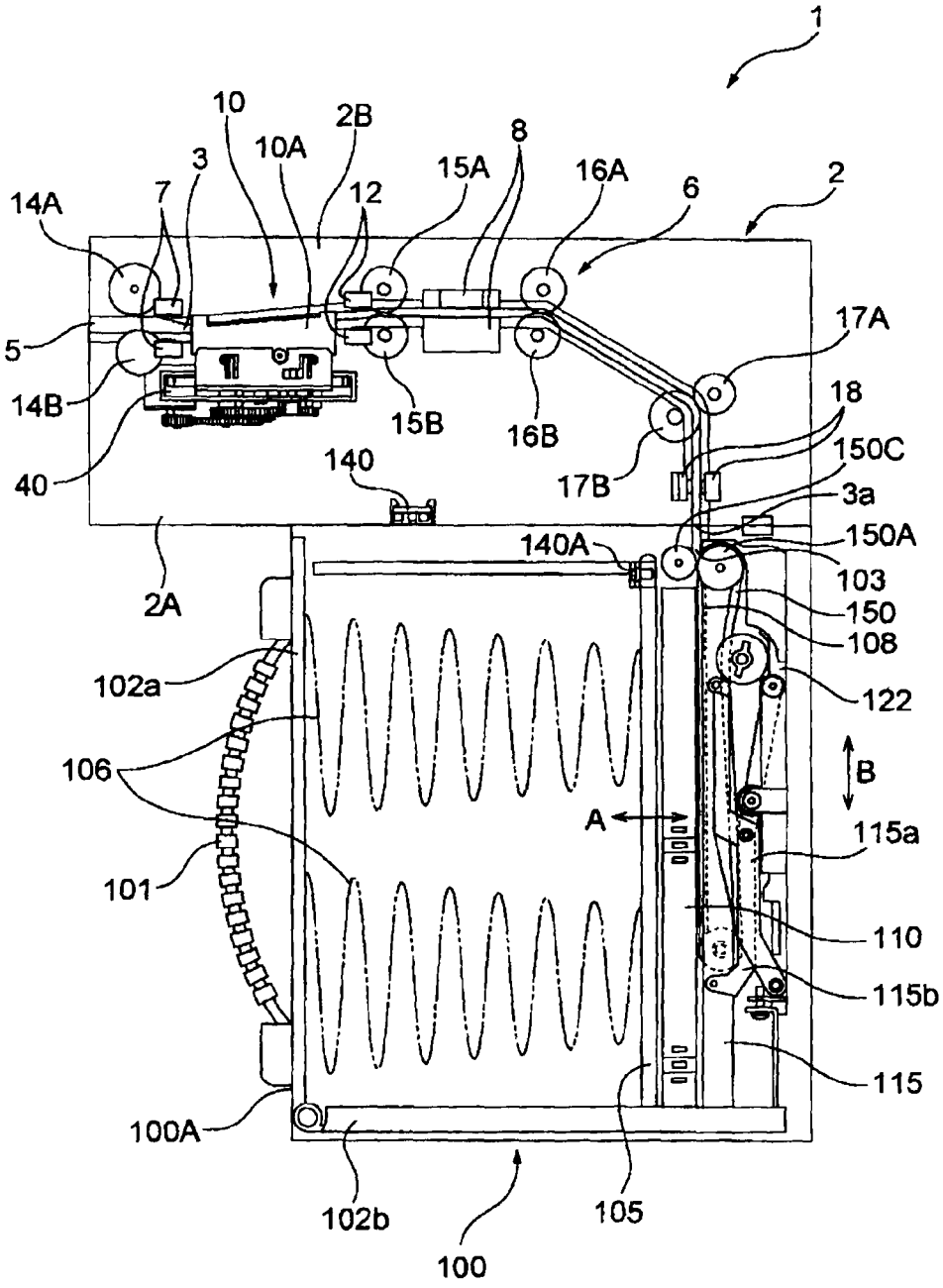
FIG. 4 is a right side view schematically showing a traveling route of a bill to be inserted from an insertion slot.
Figure 5:
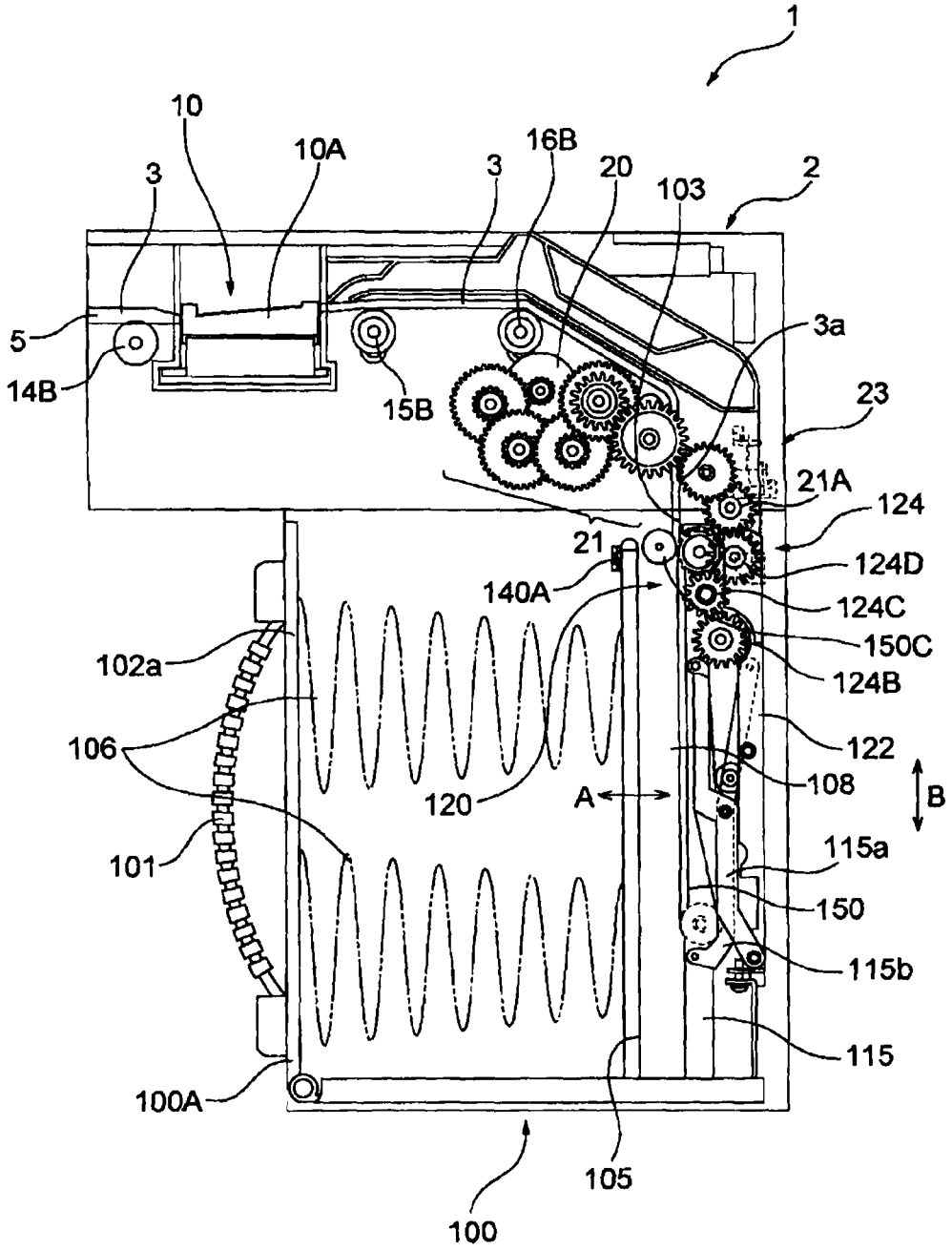
FIG. 5 is a view showing a schematic configuration of a power transmission mechanism for driving the presser plate arranged in a bill housing part.
Figure 6:
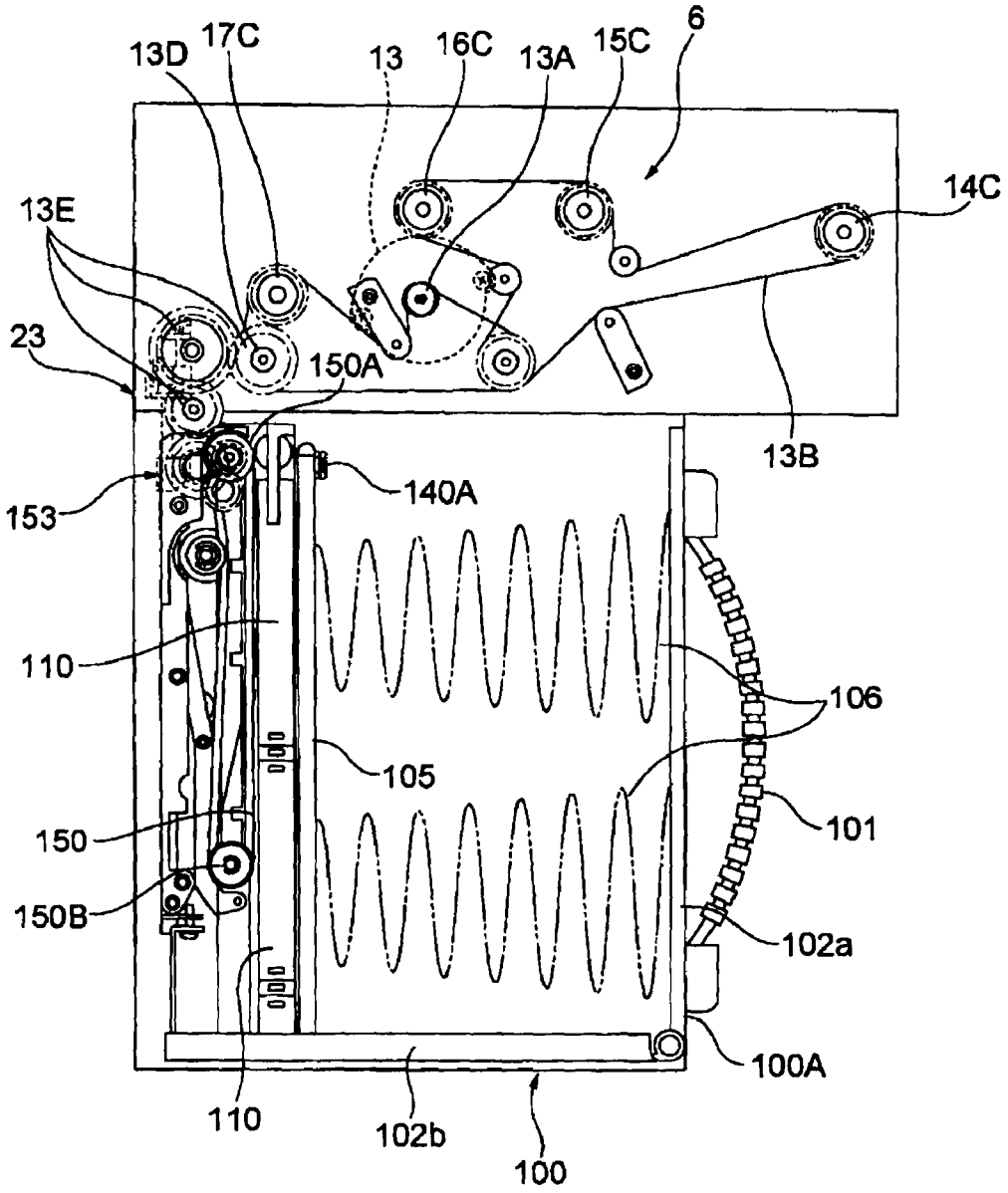
FIG. 6 is a left side view showing a schematic configuration of a driving source and a driving force transmission mechanism to drive a bill conveyance mechanism.

FIGS. 1 to 6 are diagrams showing the configuration of a bill processing apparatus of a paper sheet processing apparatus as one of the embodiments according to the present invention. FIG. 1 is a perspective view showing a general configuration thereof, FIG. 2 is a perspective view showing a state that an open/close member is opened for a main body frame of an apparatus main body, FIG. 3 is a perspective view showing a configuration of a power transmission part of the apparatus main body, FIG. 4 is a right side view schematically showing a traveling route of a bill inserted from an insertion slot, FIG. 5 is a view showing a schematic configuration of a power transmission mechanism to drive a presser plate disposed in a bill housing part, and FIG. 6 is a left side view showing a schematic configuration of a driving source and a driving force transmission mechanism to drive a bill conveyance mechanism.

A bill processing apparatus 1 of this embodiment is configured to be incorporable into, for example, various types of gaming machines such as slot machines, and the bill processing apparatus 1 includes an apparatus main body 2 and a bill housing part (e.g., bill stacker or cashbox) 100 which is provided on the apparatus main body 2, and is capable of laminating and housing a great number of bills. The bill housing part 100 has a function as a safe and is configured to be mountable to and demountable from a frame 2A constituting the apparatus main body 2. In this embodiment, for example, it is possible to remove the bill housing part 100 from the frame 2A of the apparatus main body 2 by pulling a handle 101 fixed to a front face thereof in a state that a lock mechanism (not shown) is unlocked.

As shown in FIGS. 2 and 3, the apparatus main body 2 has the frame 2A and an open/close member 2B configured to be opened and closed for the frame 2A by rotating around an axis positioned at one end thereof as a rotating center. Then, as shown in FIG. 4, the frame 2A and the open/close member 2B are configured to form a space (bill traveling route) 3 through which a bill is carried such that both face each other across the space when the open/close member 2B is closed for the frame 2A, and to form a bill insertion slot 5 such that front exposed faces of both are aligned and that the bill traveling route 3 exits at the bill insertion slot 5. In addition, the bill insertion slot 5 is a slit-like opening from which a short side of a bill can be inserted into the inside of the apparatus main body 2.

In the apparatus main body 2, a bill conveyance mechanism that conveys a bill; an insertion detecting sensor 7 that detects the bill inserted into the bill insertion slot 5; bill reading means 8 that is installed on a downstream side of the insertion detecting sensor 7, and reads information from the bill in a travelling sate; a skew correction mechanism 10 that accurately positions and conveys the bill with respect to the bill reading means 8; a movable piece passage detecting sensor 12 that detects that the bill passes through movable pieces constituting the skew correction mechanism 10; a discharge detecting sensor 18 that detects that the bill is discharged into the bill housing part 100; detection means 23 for detecting a position of a presser plate 115 pressing the bill toward a placing plate 105 in the bill housing part 100; and control means 200 (a control circuit board 200A; refer to FIG. 15) for controlling the driving of the bill conveyance mechanism 6, the bill reading means 8, the skew correction mechanism 10, and the detection means 23 are provided.

Hereafter, the respective components described above will be described in detail.

The bill traveling route 3 is extended from the bill insertion slot 5 toward the back side, and is formed to be bent so as to be inclined downward on its rear side, and to be eventually bent in the vertical direction. A discharge slot 3*a* from which the bill is discharged into the bill housing part 100 is formed in the bill traveling route 3, and the bill discharged therefrom is fed into a feed port (receiving port) 103 of the bill housing part 100 in the vertical direction.

The bill conveyance mechanism 6 is a mechanism capable of carrying the bill inserted from the bill insertion slot 5 along the insertion direction, and of carrying back the bill in an insertion state toward the bill insertion slot 5. The bill conveyance mechanism 6 comprises a motor 13 (refer to FIG. 6) serving as a driving source installed in the apparatus main body 2; and conveyor roller pairs (14A and 14B), (15A and 15B), (16A and 16B), and (17A and 17B) which are installed at predetermined intervals along the bill traveling direction in the bill traveling route 3, and are driven to rotate by the motor 13.

The conveyor roller pairs are installed so as to be partially exposed on the bill traveling route 3, and all the pairs are constituted of driving rollers of the conveyor rollers 14B, 15B, 16B, and 17B installed on the underside of the bill traveling route 3 driven by the motor 13; and pinch-rollers of the conveyor rollers 14A, 15A, 16A, and 17A installed on the upperside and driven by the these driving rollers. In addition, the conveyor roller pair (14A and 14B) to first nip and hold therebetween the bill inserted from the bill insertion slot 5, and to carry the bill toward the back side, as shown in FIGS. 2 and 3, is installed in one portion of the center position of the bill traveling route 3, and a couple of the conveyor roller pairs (15A and 15B), (16A and 16B), or (17A and 17B) being disposed in this order on the downstream side thereof are respectively installed in a couple of portions with a predetermined interval in the lateral direction of the bill traveling route 3.

Further, the conveyor roller pair (14A and 14B) disposed in the vicinity of the bill insertion slot 5 is usually in a state that the upper conveyor roller 14A is spaced from the lower conveyor roller 14B, and the upper conveyor roller 14A is driven to move toward the lower conveyor roller 14B to nip and hold the inserted bill therebetween when insertion of the bill is sensed by the insertion detecting sensor 7. In addition, the upper conveyor roller 14A is controllably driven to be pressed against or spaced from the conveyor roller 14B by a driving source 70 (refer to a block diagram of FIG. 15). The driving source 70 may comprise a motor, solenoid, and the like, and is installed in the open/close member 2B.

Then, the upper conveyor roller 14A is spaced from the lower conveyor roller 14B so as to release the load on the bill when a process (skew correction process) for positioning the bill for the bill reading means 8 by eliminating tilt of the inserted bill is executed by the skew correction mechanism 10, and the upper conveyor roller 14A is driven to move toward the lower conveyor roller 14B again to nip and hold the bill therebetween when the skew correction process is completed. The skew correction mechanism 10 comprises a pair of right and left movable pieces 10A (only one side is shown) that perform skew correction and the skew correction process is performed by driving a motor 40 for a skew driving mechanism.

The conveyor rollers 14B, 15B, 16B and 17B installed on the underside of the bill traveling route 3 are, as shown in FIG. 6, driven to rotate via the motor 13 and pulleys 14C, 15C, 16C, and 17C installed at the ends of the driving shafts of the respective conveyor rollers. That is, a driving pulley 13A is installed on the output shaft of the motor 13, and a driving belt 13B is wrapped around between the pulleys 14C, 15C, 16C, and 17C installed at the ends of the driving shafts of the respective conveyor rollers and the driving pulley 13A. In addition, tension pulleys are engaged in places with the driving belt 13B, which prevents the driving belt 13B from loosening.

In accordance with the configuration described above, when the motor 13 is driven to normally rotate, the conveyor rollers 14B, 15B, 16B, and 17B are driven to normally rotate in synchronization therewith to carry the bill toward the insertion direction. When the motor 13 is driven to reversely rotate, the conveyor rollers 14B, 15B, 16B, and 17B are driven to reversely rotate in synchronization therewith to carry back the bill toward the bill insertion slot 5 side.

The insertion detecting sensor 7 is to generate a detection signal when a bill inserted into the bill insertion slot 5 is detected. In this embodiment, the insertion detecting sensor 7 is installed between the pair of conveyor rollers (14A and 14B) and the skew correction mechanism 10. The insertion detecting sensor 7 comprises, for example, an optical sensor such as a regressive reflection type photo sensor. However, the insertion detecting sensor 7 may comprise a mechanical sensor other than the optical sensor.

Further, the movable piece passage detecting sensor 12 is to generate a sensed signal when it is sensed that a front end of the bill passes through a pair of right and left movable pieces 10A constituting the skew correction mechanism 10, and the movable piece passage detecting sensor 12 is installed on the upstream side of the bill reading means 8. The movable piece passage detecting sensor 12 also comprises an optical sensor or a mechanical sensor in the same way as mentioned before with respect to the insertion detecting sensor.

Further, the discharge detecting sensor 18 is to detect a back end of the bill passing through such that it is detected that the bill is discharged into the bill housing part 100. The discharge detecting sensor 18 is disposed just in front of the receiving port 103 of the bill housing part 100 on the downstream side of the bill traveling route 3. The discharge detecting sensor 18 also comprises an optical sensor or a mechanical sensor in the same way as the aforementioned insertion detecting sensor.

The bill reading means 8 reads bill information on the bill carried in a state that the skew is eliminated by the skew correction mechanism 10 (in a state that the bill is accurately positioned), and judges whether the bill is true or false. In detail, for example, the bill reading means 8 may comprise a line sensor that performs reading of the bill such that a bill to be carried is irradiated with light from upper and lower sides, and transmitted light therethrough and reflected light therefrom are detected by a light receiving element. A line sensor is shown in the drawing, and an optical signal read by the line sensor is photoelectric-converted, and the signal is compared and checked with data of a legitimate bill stored in advance, which makes it possible to identify the authenticity of the bill to be carried.

Next, the configuration of the bill housing part 100 and the configuration of detection means 23 capable of detecting a position of a presser plate that presses bills toward a placing plate will be described with reference to FIGS. 7 to 14 in addition to FIGS. 4 to 6.

Figure 7:
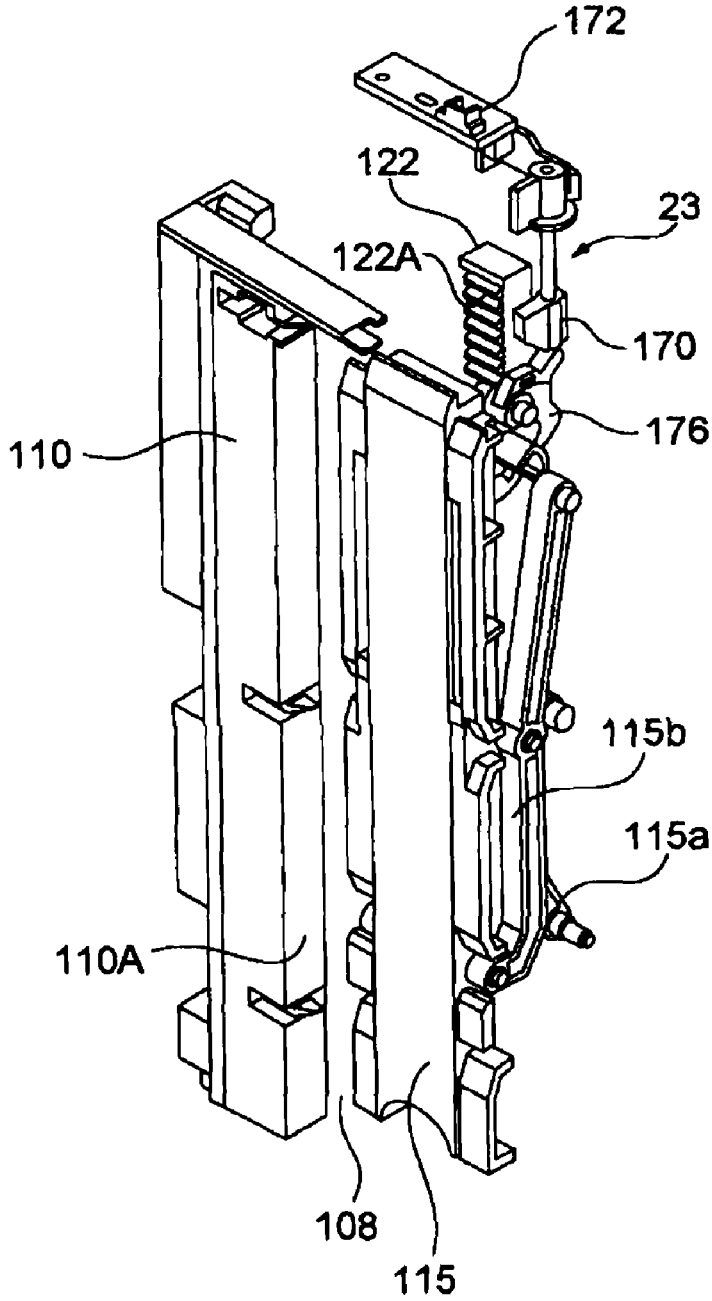
FIG. 7 is a perspective view with some missing parts showing a driving mechanism of the presser plate.
Figure 8:
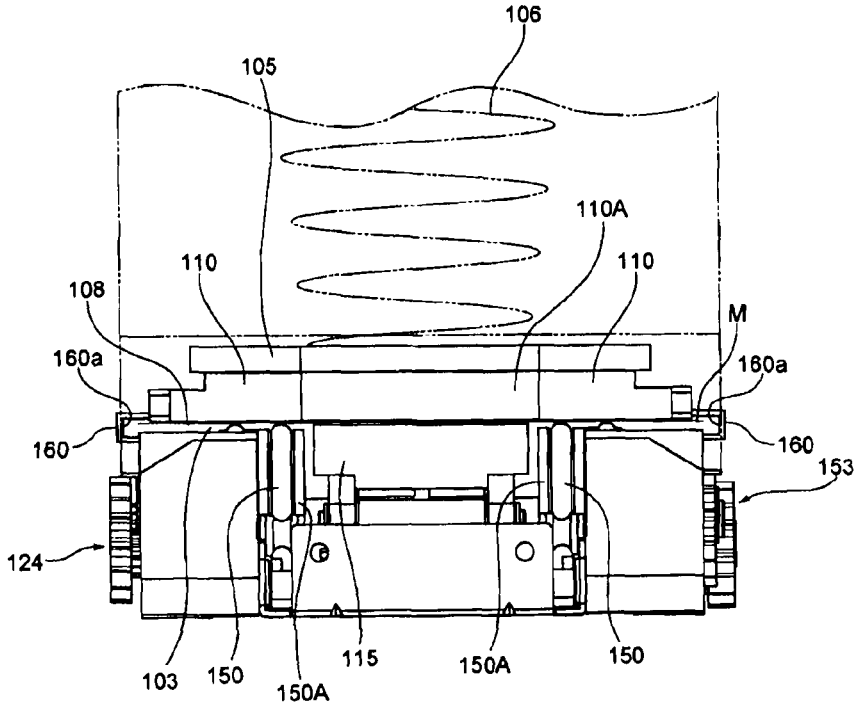
FIG. 8 is a plan view showing a receiving port potion of the bill housing part in a state that the presser plate is positioned at a home position.
Figure 9:
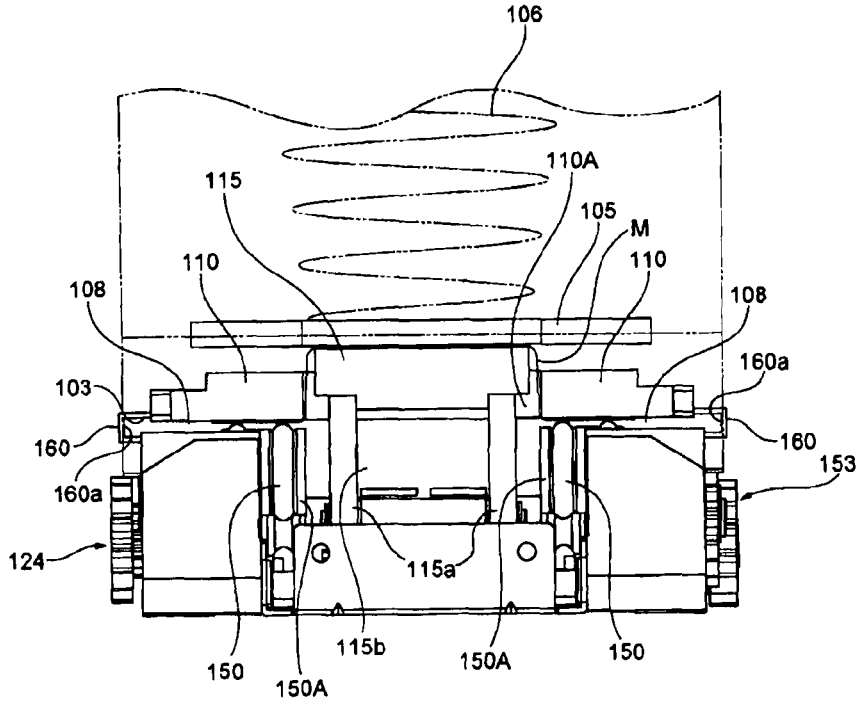
FIG. 9 is a plan view showing the receiving port portion of the bill housing part in a state that the presser plate is at a pressing position (at a maximum stroke position).
Figure 10:
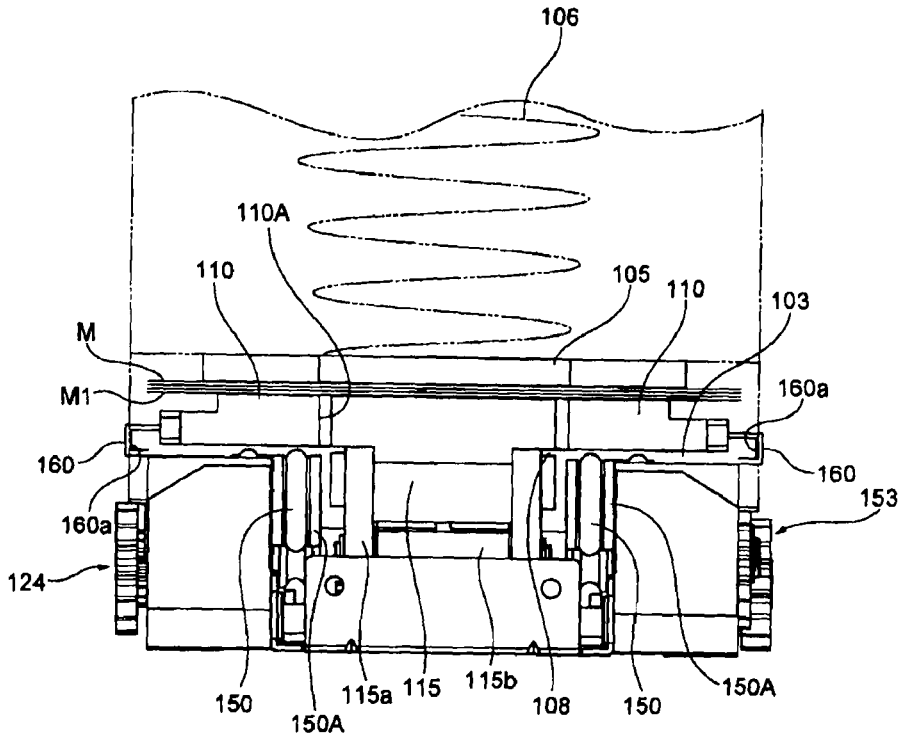
FIG. 10 is a plan view showing the receiving port portion of the bill housing part in a state that the presser plate is at a standby position.
Figure 11A:
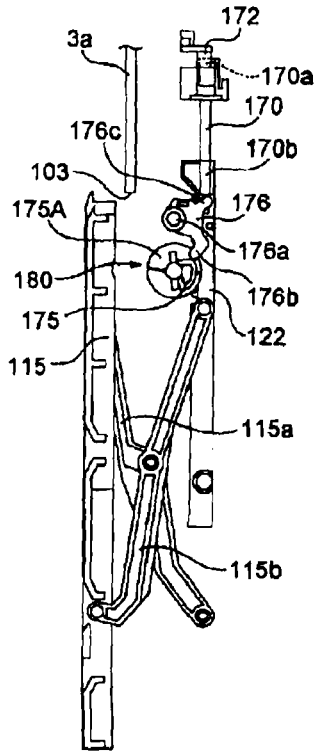
FIG. 11A is a view showing the state that the presser plate is at the standby position with respect to a relation between the presser plate and detection means.
Figure 11B:
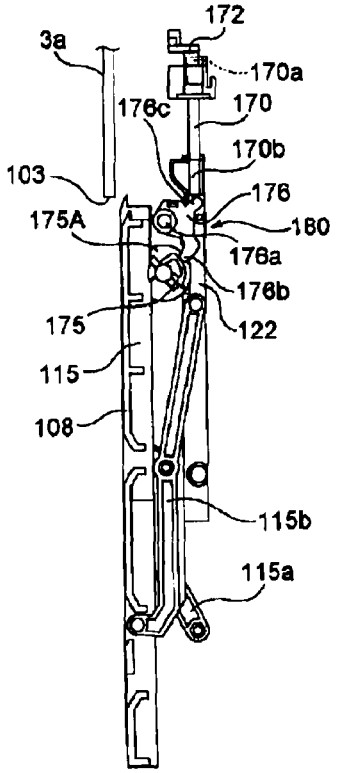
FIG. 11B is a view showing a state that the presser plate is at an initial position (home position) with respect to the relation between the presser plate and detection means.
Figure 11C:
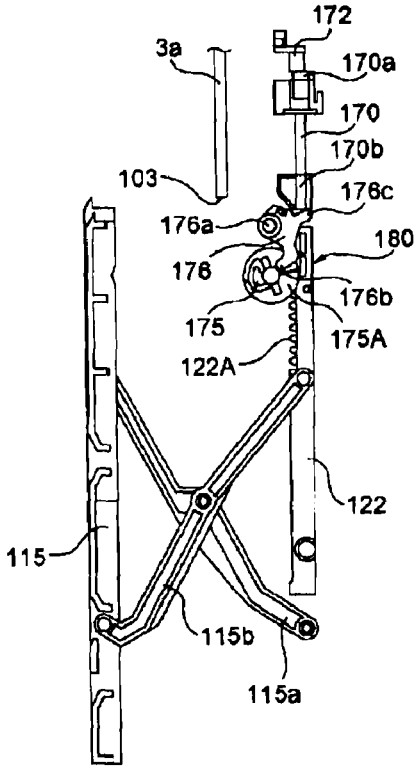
FIG. 11C is a view showing a state that the presser plate is at the pressing position with respect to the relation between the presser plate and detection means.
Figure 12A:
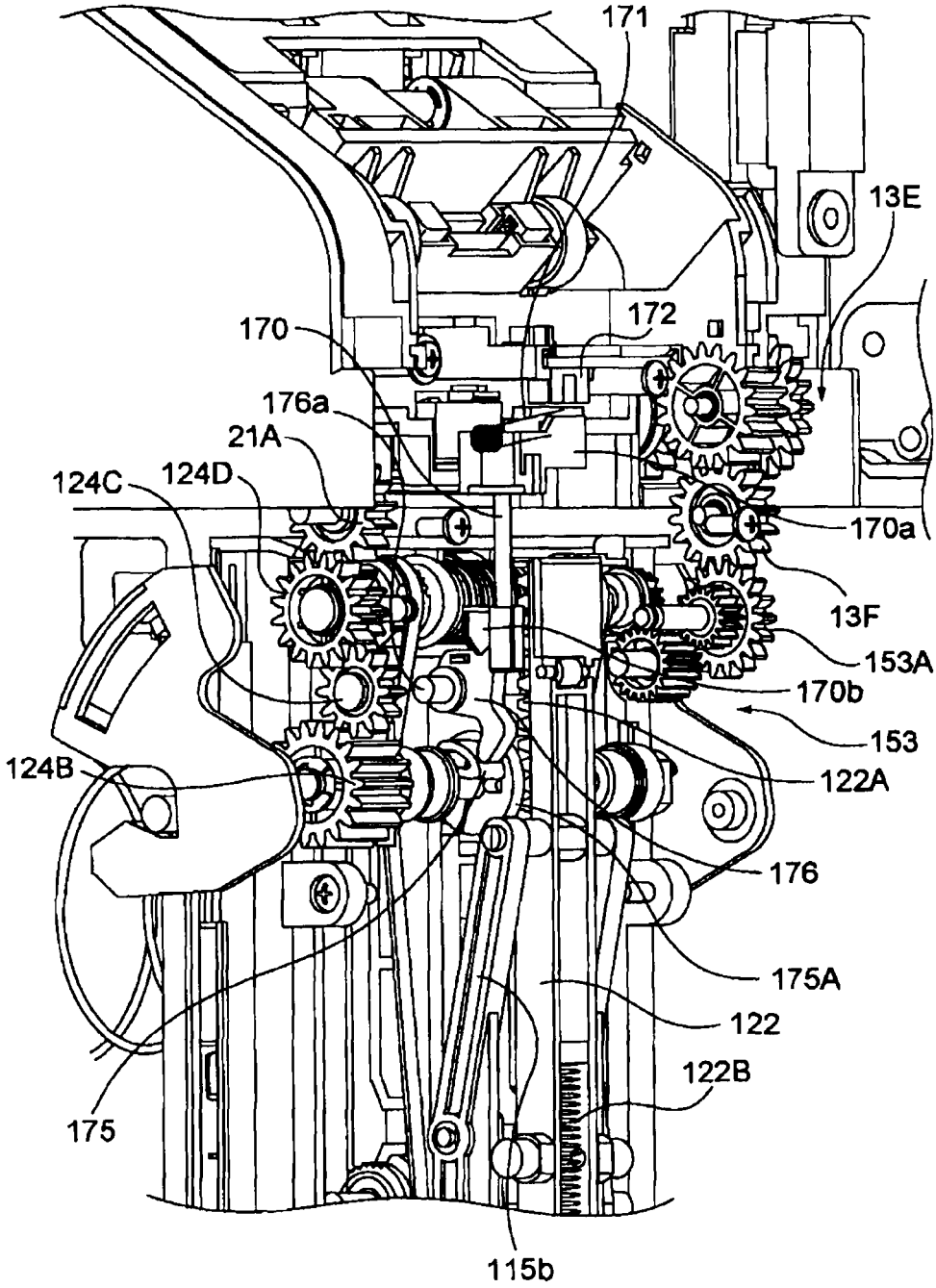
FIG. 12A is a perspective view showing partially the detection means capable of detecting a position of the presser plate.
Figure 12B:
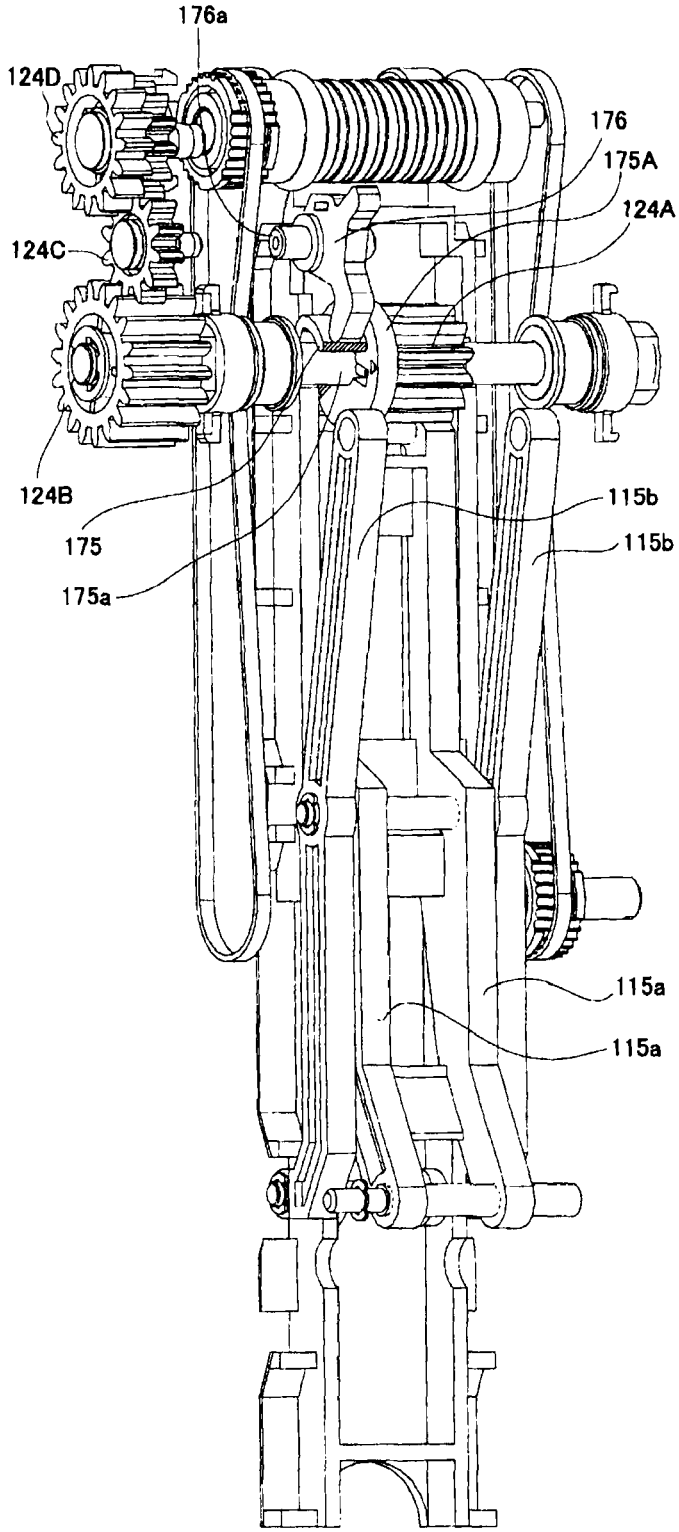
FIG. 12B is a perspective view showing a housing part side gear train constituting a presser plate driving mechanism.
Figure 13:
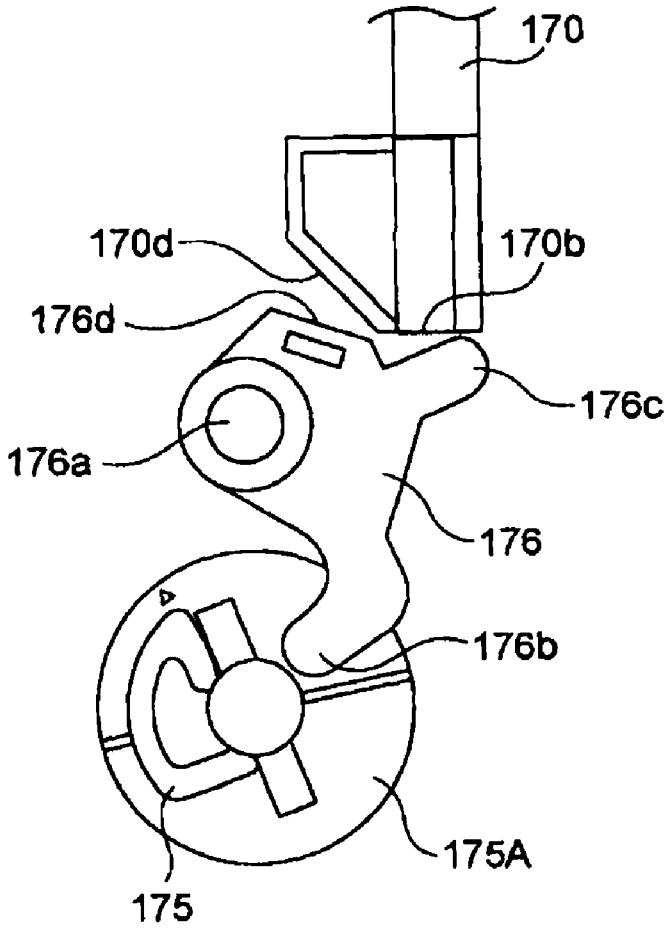
FIG. 13 is an enlarged view showing a main part of the detection means capable of detecting a position of the presser plate.
Figure 14:
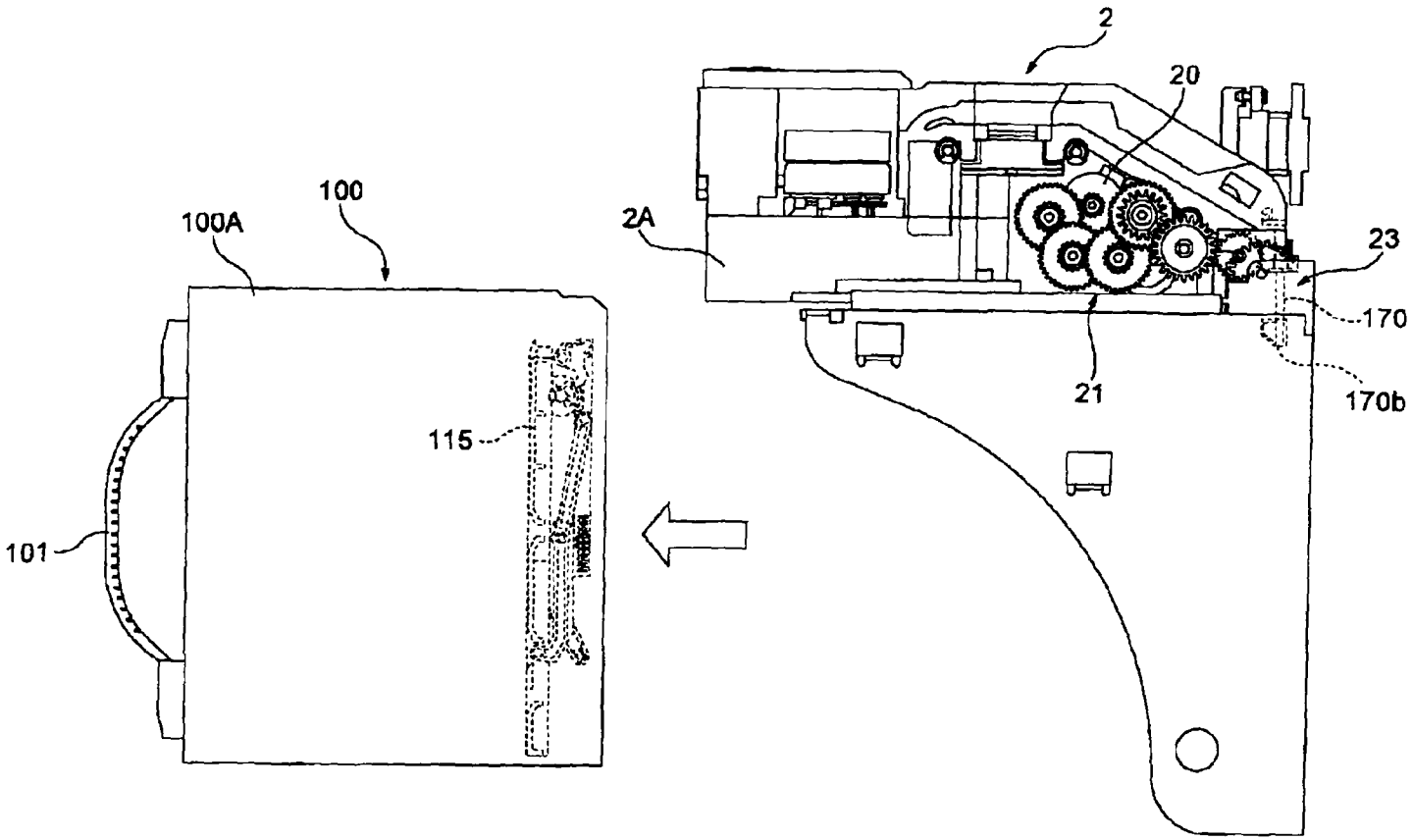
FIG. 14 is a side view showing a state that the bill housing part is demounted from the frame.

In addition, among these drawings, FIG. 7 is a perspective view showing a driving mechanism of the presser plate in a partially broken manner, FIG. 8 is a plan view showing a receiving port portion of the bill housing part in a state that the presser plate is at a home position, FIG. 9 is a plan view showing the receiving port portion of the bill housing part in a state that the presser plate is at a pressing position (a maximum stroke position), FIG. 10 is a plan view showing the receiving port portion of the bill housing part in a state that the presser plate is at a standby position, FIG. 11A is a view showing the state that the presser plate is at the standby position with respect to a relation between the presser plate and detection means, FIG. 11B is a view showing a state that the presser plate is at an initial position (home position) with respect to the relation between the presser plate and detection means, FIG. 11C is a view showing a state that the presser plate is at the pressing position with respect to the relation between the presser plate and detection means, FIG. 12A is a perspective view showing partially the detection means capable of detecting a position of the presser plate, FIG. 12B is a perspective view showing a housing part side gear train constituting a presser plate driving mechanism, FIG. 13 is an enlarged view showing a main part of the detection means capable of detecting a position of the presser plate, and FIG. 14 is a side view showing a state that the bill housing part is demounted from the main body frame.

The bill housing part 100 that houses bills is so configured as to be mountable to and demountable from the frame 2A of the apparatus main body 2 (refer to FIG. 14), and to house and stack sequentially the bills identified as being genuine by the bill reading means 8.

As shown in FIGS. 4 to 6, the main body frame 100A constituting the bill housing part 100 is formed into a substantially rectangular parallelepiped (or cuboid) shape, and one end of bias means (e.g., bias spring) 106 is attached to an interior side of a front wall 102*a* thereof, and a placing plate 105 on which bills to be fed via the above-described receiving port 103 are sequentially stacked is provided to the other end thereof. Therefore, the placing plate 105 is in a state that it is pressed toward the presser plate 115, which will be described later, by the bias means 106.

In the main body frame 100A, a press standby part 108 that keeps a dropping bill as it falls is provided so as to continuously communicate with the receiving port 103. A pair of regulatory members 110 are disposed on both sides of the press standby part 108, respectively, the regulatory members 110 extending in a vertical direction. The pair of regulatory members 110 take a holding role to hold the stacked bills stably by contacting both sides of a surface of an uppermost bill M1 of the stacked bills when bills are sequentially stacked on the placing plate 105 and the placing plate 105 is biased by the biasing means 106 (refer to FIG. 10).

Further, the presser plate 115 that presses toward the placing plate 105 a bill falling into the press standby part 108 from the receiving port 103 is installed in the main body frame 100A. The presser plate 115 is formed in such a size that it may be capable of reciprocating through an opening 110A formed between the pair of regulatory members 110, and gets into the opening 110A so as to be driven to reciprocate between a position where the bills are pressed against the placing plate 105 (a pressing position; refer to FIGS. 9 and 11C) and another position where the press standby part 108 is opened (an initial position; refer to FIGS. 8 and 11B).

The presser plate 115 is driven to reciprocate as described above via a presser plate driving mechanism 120 installed in the main body frame 100A. The presser plate driving mechanism 120 comprises a pair of link members 115*a* and 115*b* having respective ends thereof supported pivotally by the presser plate 115 so as to allow the presser plate 115 to reciprocate in an arrow A direction in FIG. 5, and these link members 115*a* and 115*b* are connected in a shape of letter "X", and the other ends opposite to the respective ends are supported pivotally by a movable member 122 installed movably in a vertical direction (an arrow B direction). A rack 122A is formed in the movable member 122, and a pinion 124A constituting the presser plate driving mechanism 120 is geared (engaged) with the rack.

As shown in FIG. 5, a housing part side gear train 124 constituting the presser plate driving mechanism 120 is connected to the pinion 124A. In this case, in this embodiment, as shown in FIGS. 3 and 5, a driving source (a motor 20) and a main body side gear train 21 sequentially engaged with the motor 20 are installed in the above-described apparatus main body 2, and when the bill housing part 100 is mounted to the apparatus main body 2, the main body side gear train 21 is to be connected to the housing part side gear train 124. That is, the housing part side gear train 124, as shown in FIGS. 12A and 12B, comprises a gear 124B installed on the same axis of the pinion 124A and gears 124C, 124D to be engaged sequentially with the gear 124B, and when the bill housing part 100 is mounted to and demounted from the apparatus main body 2, the gear 124D is configured to be engaged with and disengaged from a final gear 21A of the main body side train 21. Here, FIG. 12B shows each gear of the housing part side gear train 124 when the presser plate 115 is in the home position, but a cam 175 is partially broken for better understanding of illustration of each gear.

As a result therefrom, the presser plate 115 is driven to reciprocate in the arrow A direction as the motor 20 installed in the apparatus main body 2 is driven to rotate so as to drive the main body side train 21 and in turn the presser plate driving mechanism 120 (the housing part side gear train 124, the rack 122A installed onto the movable member 122, and the link members 115*a*, 115*b*, etc.).

Further, when the above-described presser plate 115 is driven to reciprocate in the arrow A direction by the motor 20, the presser plate 115 is configured to take three positions in accordance with the stop control of the motor 20. Specifically, as shown in FIGS. 9 and 11C, the following three positions may be taken: the pressing position (maximum stroke position) where the bills are pressed against the placing plate 105; the initial position (home position) where the press standby part 108 is opened as shown in FIGS. 8 and 11B; and the standby position (position where the opening 110A of the regulatory members 110 is closed by the presser plate 115) where the pair of link members 115*a*, 115*b* prevent a bill from being carried into the press standby part 108 from the receiving port 103 such that the pair of link members 115*a*, 115*b* to drive the presser plate 115 are positioned in the press standby part 108 as shown in FIGS. 10 and 11A.

In the frame 2A of the main body 2, as shown in FIG. 4, a detecting sensor (full detecting sensor) 140 that detects the state when a predetermined number of bills are placed on the placing plate 105 is installed. The full detecting sensor is configured to be capable of detecting a magnetic signal, and is configured to be capable of detecting a magnetic field by a magnet 140A provided at a center on the rear surface of the placing plate 105. That is, the full detecting sensor 140 is installed at a predetermined position in a direction in which the placing plate 105 is pushed back, bills are sequentially placed on the placing plate 105 such that the placing plate 105 is pushed back against the bias force of the bias means 106, and the full detecting sensor 140 outputs a signal indicating that the bills on the placing plate 105 are full when the full detecting sensor 140 detects a backward movement of the placing plate 105.

Conveyor members 150 which are capable of touching the bill conveyed-in from the receiving port 103 are installed in the main body frame 100A. The conveyor members 150 take their own role to contact the bill conveyed-in so as to stably guide the bill to an appropriate position in the press standby part 108 (position where the bill can be stably pressed without causing the bill to be moved to the right or left side when the bill is pressed by the presser plate 115). In this embodiment, the conveyor members are constituted of belt-like members (hereafter called belts 150) installed so as to face the press standby part 108.

In this case, the belts 150 are installed so as to extend along the conveying-in direction with respect to the bill, and are wrapped around the pair of pulleys 150A and 150B supported rotatably on both ends in the conveying-in direction. Further, the belts 150 contact a conveyor roller 150C extending in an axis direction which is supported rotatably in the region of the receiving port 103, and the belts 150 and the conveyor roller 150C nip and hold the bill conveyed-in the receiving port 103 therebetween to guide the bill directly to the press standby part 108. Moreover, in this embodiment, the pair of belts 150 are provided on the right and left sides, respectively, across the above-described presser plate 115 in order to be capable of contacting the surface on left and right sides of the bill.

Here, the belts 150 may be prevented from loosening by not only being wrapped around the pulleys 150A and 150B at the both ends, but also causing tension pulleys to push the belts 150 at the intermediate positions, respectively.

The pair of belts 150 are configured to be driven by the motor 13 that drives the above-described plurality of conveyor rollers installed in the apparatus main body 2. In detail, as shown in FIG. 6, the above-described driving belt 13B driven by the motor 13 is wrapped around a pulley 13D for the driving force transmission, and a gear train 153 installed at the end of the spindle of the pulley 150A supported rotatably on the receiving port 103 side is engaged with a gear train 13E for the power transmission sequentially installed onto the pulley 13D. That is, when the bill housing part 100 is mounted to the apparatus main body 2, an input gear 153A of the gear train 153 is configured to be engaged with a final gear 13F of the gear train 13E, and the pair of belts 150 are configured to be driven to rotate in a synchronized manner with the above-described conveyor rollers 14B, 15B 16B, and 17B for conveying the bill by driving the motor 13 to rotate.

In this way, when driving the belts 150 installed in the bill housing part, the motor 13 serving as the driving source of the bill conveyance mechanism 6 provided in the apparatus main body 2 is utilized, thereby reducing the cost.

As shown in FIG. 8, guide members 160 regulating the both side edges of the bill are formed to extend along the conveying-in direction of the bill from the receiving port 103 in the main body frame 100A. The guide members 160 have U-shaped guide faces 160*a* being installed on the lateral end portions and regulating the both side edges of the bill to be conveyed in. The U-shaped guide faces 160*a* are arranged to lie on respective sides such that openings thereof face each other. When the bill is conveyed inside the bill housing part (the press standby part 108) from the receiving port 103, the guide faces 160*a* allow the bill to move along the guide member 160, and the bill and the pair of belts 150 can slidingly contact each other stably. In this way, it is prevented that the bill is shifted on either side when the bill is conveyed into the press standby part 108, thereby making it possible to more reliably convey the bill to an appropriate position.

Next, the configuration of the detection means 23 described above will be described. The detection means 23 is configured to be capable of detecting a position of the presser plate 115 that presses the bill toward the placing plate 105, and in this embodiment, the detection means 23 is provided so as to be associated with the rack 122A and the pinion 124A that drive the presser plate 115. Further, the detection means 23 is configured to be capable of detecting the mounting or demounting operation when the bill housing part 100 is mounted to or demounted from the frame 2A of the apparatus main body 2.

The detection means 23 has a detecting member 170 movable according to a movement of the presser plate 115, a sensor 172 that detects that the detecting member 170 is moved according to the movement of the presser plate 115 to the pressing position, and a moving mechanism 180 that causes the detecting member 170 to move so as to become detectable by a sensor 172 when the bill housing part 100 is demounted from the frame 2A.

The detecting member 170 is, as shown in FIGS. 11A, 11B, 11C, and 12A, supported by the frame 2A of the apparatus main body 2 so as to be movable in the vertical direction, and a detecting part 170*a* is formed on one end side thereof, and an engaging part 170*b* is formed on the other end side.

The sensor 172 comprises an optical system sensor element, and as is publicly known, the sensor 172 is configured to operate between a light emitting part and a light receiving part so as to be capable of detecting a movement of the detecting part 170*a* of the detecting member 170. The detecting member 170 is always biased toward the bill housing part by a biasing member 171, and the movement of the detecting member 170 by a bias force is limited by the engaging part 170*b* formed on the other end side and the moving mechanism 180 which will be described later.

The moving mechanism 180 comprises a cam member 175A which is installed to be coaxially adjacent to a pinion 124A engaged with the rack 122A, a cam 175 which is formed on the cam member 175A, and a cam follower (transmission member) 176 installed between the cam 175 and the engaging part 170*b* formed on the other end side of the detecting member 170.

A relationship among the pinion 124A, the cam 175, the cam follower 176, the engaging part 170*b* formed on the detecting member 170, and the sensor 172 that detects a movement of the detecting part 170*a* will be described with reference to FIGS. 11A to 13.

The cam 175 formed on the cam member 175A has such a shape that the detecting member 170 is moved by the cam follower 176 when the presser plate 115 is moved between the pressing position as shown in FIG. 11C and the standby position as shown in FIG. 11A, and that the movement of the detecting member 170 is limited by the cam follower 176 when the presser plate 115 is moved between the standby position as shown in FIG. 11A and the initial position as shown in FIG. 11B.

That is, when the presser plate 115 is moved from the standby position as shown in FIG. 11A to the initial position as shown in FIG. 11B, the detecting member 170 does not move due to the shape of the cam 175, the detection thereof by the sensor 172 is not carried out. Further, when the presser plate 115 is moved from the initial position as shown in FIG. 11B to the pressing position as shown in FIG. 11C, the detecting member 170 is moved downward by the biasing force of the biasing member 171, and the cam 175 and the cam follower 176, and its state (the movement to the pressing position) is detected by the sensor 172 (it is detected that the detecting part 170*a* becomes apart from the sensor 172). Then, when the presser plate 115 is moved from the pressing position as shown in FIG. 11C to the standby position as shown in FIG. 11A, the detecting member 170 is moved upward by the cam 175 and the cam follower 176, and its state (the movement to the standby position) is detected by the sensor 172 (the detecting part 170*a* is detected by the sensor 172).

In addition, as the presser plate 115 is moved from the pressing position (FIG. 11C) to the standby position (FIG. 11A), and then to the home position (FIG. 11B), the cam 175 rotates counterclockwise along with the cam member in FIG. 13 in synchronization with the rotation of the pinion 175A. The cam 175 is formed by bending a rectangular plate having both end portions such that an arc of a smaller circle than that in the side view of the cam member is formed and the respective end portions of the plate are fixed to a rotation axis 175*a* of the cam 175 such that the cam 175 is fixed. Bending portions toward the respective end portions from an outer portion forming the arc are formed into a leading part where the bending portion is bent with an acute angle and formed into a tail part where the other bending portion is bent with an approximately right angle. Therefore, a side view of the cam 175 appears to be a wedge-like shape having a curved slant surface. As the cam has such a cam shape, it is possible to make a peculiar movement as described below in combination with the shape of the cam follower 176. When the presser plate 115 is in the pressing position (FIG. 11C), a cam touching part 176*b* of the cam follower 176 touches only the rotation axis 175*a* of the cam 175. Then, the contact of the cam touching part 176*b* with the rotation axis 175*a* of the cam 175 becomes a contact with a tail surface of the wedge-like shape when the presser plate 115 is moved closer to the standby position (FIG. 11A). Further, the cam touching part 176*b* leaves the tail surface of the wedge-like shape and starts to contact the roundly-curved slant surface (side surface) by moving the contact position when the presser plate 115 reaches the standby position (FIG. 11A). Further, when the presser plate 115 is moved to the home position (FIG. 11B), the cam touching part 176*b* slides on the round side surface showing an arc having substantially the same distance from the center in the side view. Therefore, the cam follower 176 does not rotate during this period since the cam touching part 176*b* moves on the arc having the same distance from the rotation axis 175*a*.

Further, the cam follower 176 is supported rotatably around the axis 176*a* serving as a fulcrum shaft by the main body frame 100A, and a cam touching part 176*b* to touch the cam 175 is formed on one end side in the rotation direction, and a detecting member touching part 176*c* to touch the engaging part 170*b* formed on the detecting member 170 is formed on the other end side in the rotation direction.

In this case, as shown in FIG. 13 (showing at the pressing position), a guide face (inclined surface) 170*d* to be engaged with the detecting member touching part 176*c* of the cam follower 176 so as to move the detecting member 170 to a detectable position by the sensor 172 when the bill housing part 100 is mounted to the frame 2A, is formed to be adjacent to the engaging part 170*b* on the detecting member 170.

In addition, a rotation regulating part 176*d* is formed to be adjacent to the detecting member touching part 176*c* on the cam follower 176 such that the rotation is regulated with the guide face 170*d* of the detecting member 170 when the presser plate 115 is moved to the pressing position. That is, since the rotation regulating part 176*d* is provided as shown in FIG. 13, the rotation of the cam follower 176 supported rotatably is prevented by blocking the rotation regulating part 176*d* with the guide face 170*d* of the detecting member 170 such that the cam follower 176 can be kept in a stable condition, thereby enabling the sensor 172 to reliably detect the movement of the detecting member 170.

Further, when the bill housing part 100 is demounted from the frame 2A of the apparatus main body 2 as shown in FIG. 14, the detecting member 170 described above is released from the engagement with the cam follower 176 so as to be moved toward the bill housing part by the biasing member 171 as shown in FIG. 12A. The movement of the detecting member 170, that is, the movement of the detecting part 170*a* by demounting the bill housing part 100 from the frame 2A is detected by the sensor 172.

And a biasing spring 122B that always biases the movable member 122 itself toward the apparatus main body is installed on the movable member 122 on which the rack 122A is formed as shown in FIG. 12. That is, when the bill housing part 100 is demounted from the frame 2A of the apparatus main body 2, the rack 122A is moved to the initial position as shown in FIG. 11B by biasing force of the biasing spring 122B. As a result, when the bill housing part 100 is mounted to the frame 2A of the apparatus main body 2, the detecting member touching part 176*c* formed on the cam follower 176 as shown in FIG. 13 touches the guide face 170*d* of the detecting member 170 such that the detecting member 170 is pushed up against the biasing force of the biasing member 171 according to the shape of the guide face 170*d*. The movement of pushing up the detecting member 170, that is, the movement of the detecting part 170*a* by mounting the bill housing part 100 to the frame 2A is detected by the sensor 172.

Figure 15:
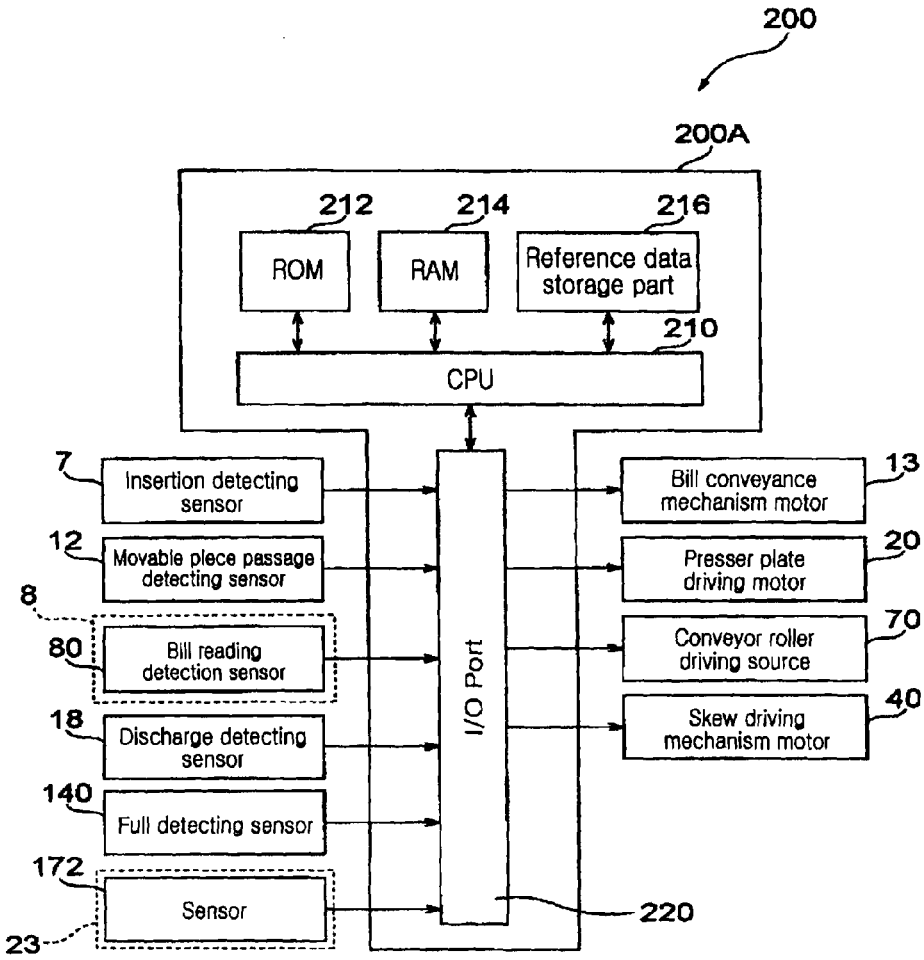
FIG. 15 is a block diagram showing a configuration of control means for controlling driving of a bill conveyance mechanism, bill reading means, the presser plate installed inside the bill housing part, and the detection means.
Figure 16:
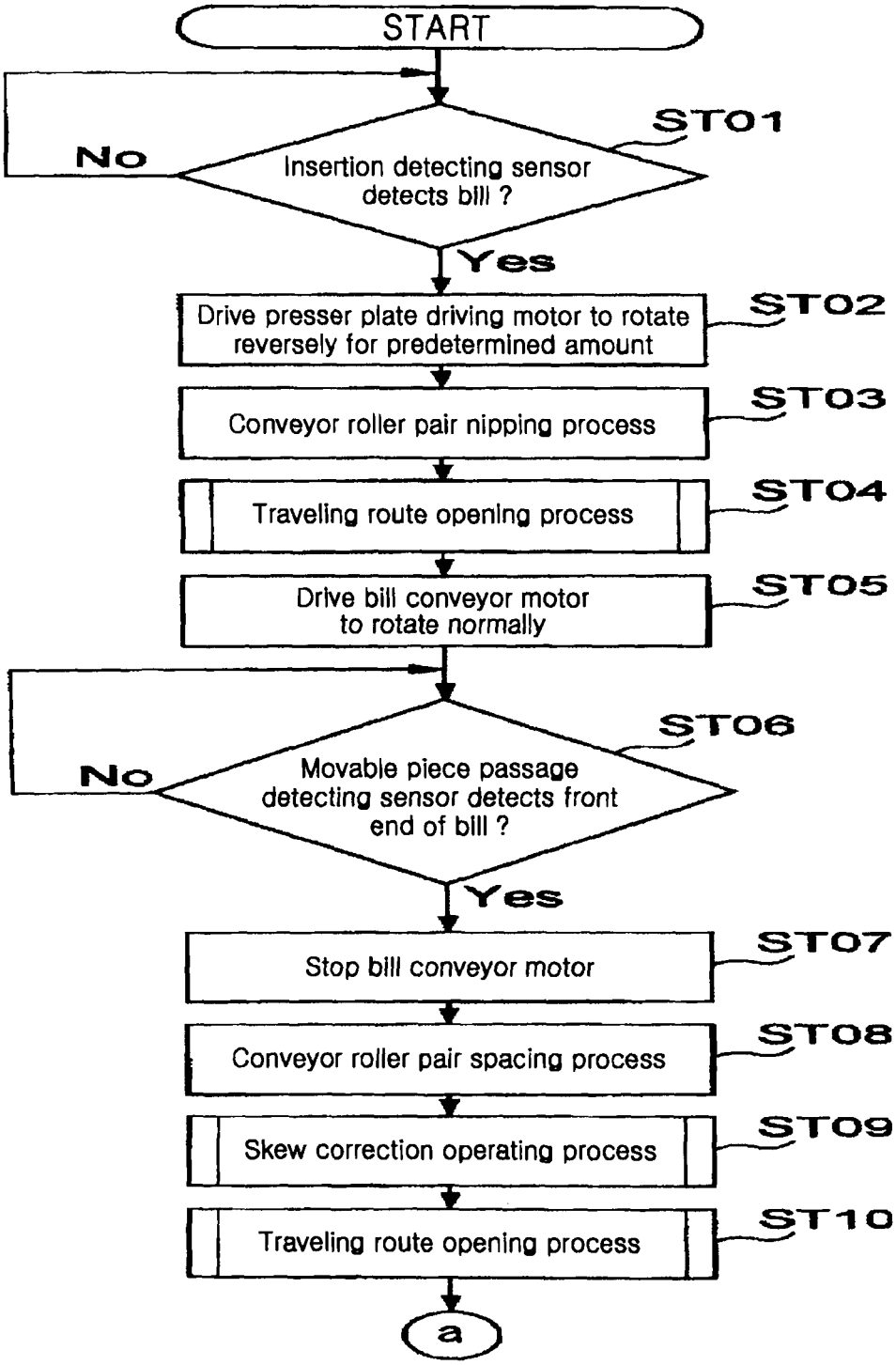
FIG. 16 shows a flowchart (part one) illustrating processing operations for processing a bill in a bill processing apparatus of this embodiment.
Figure 17:
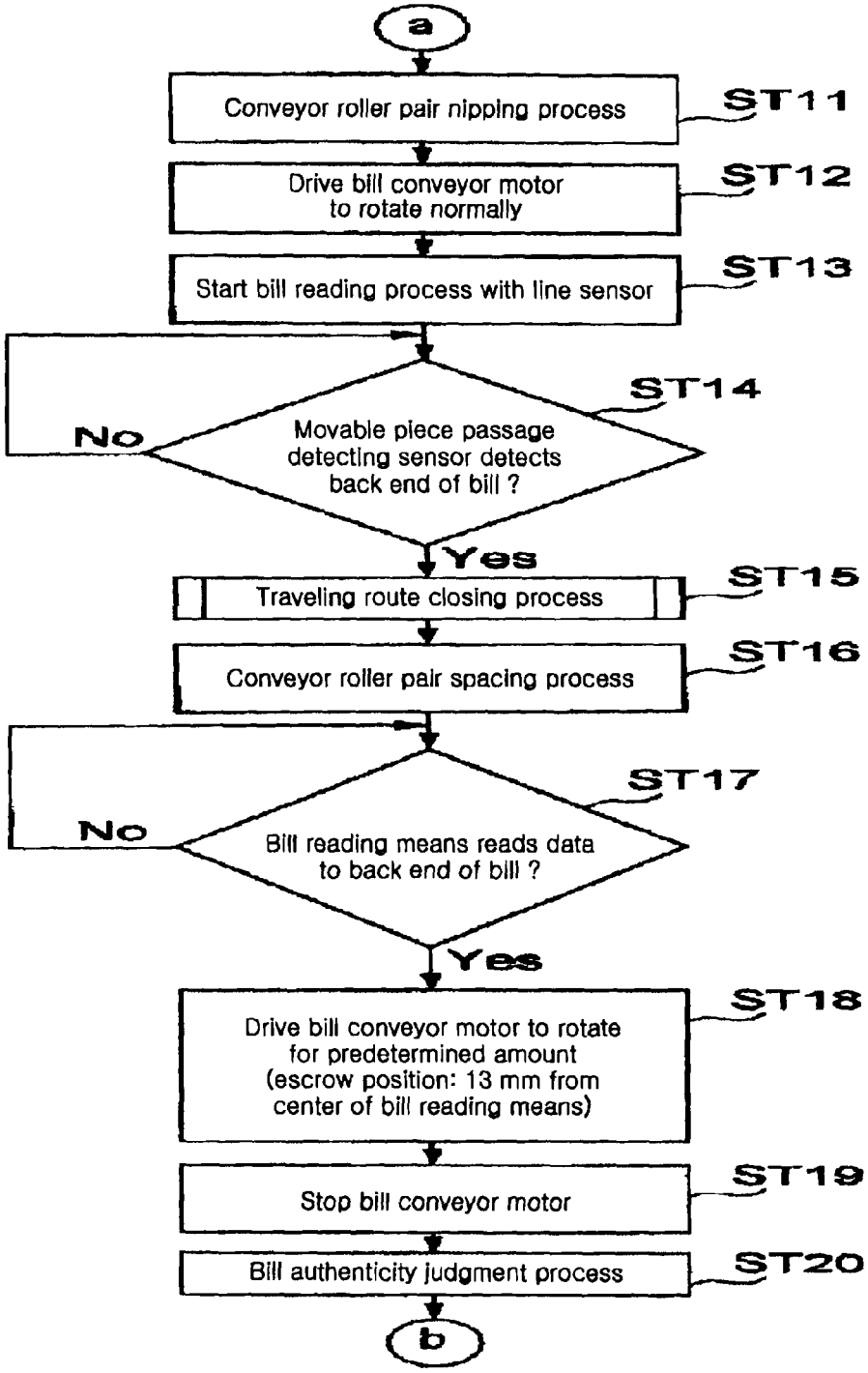
FIG. 17 shows a flowchart (part two) illustrating processing operations for processing the bill in the bill processing apparatus of this embodiment.
Figure 18:
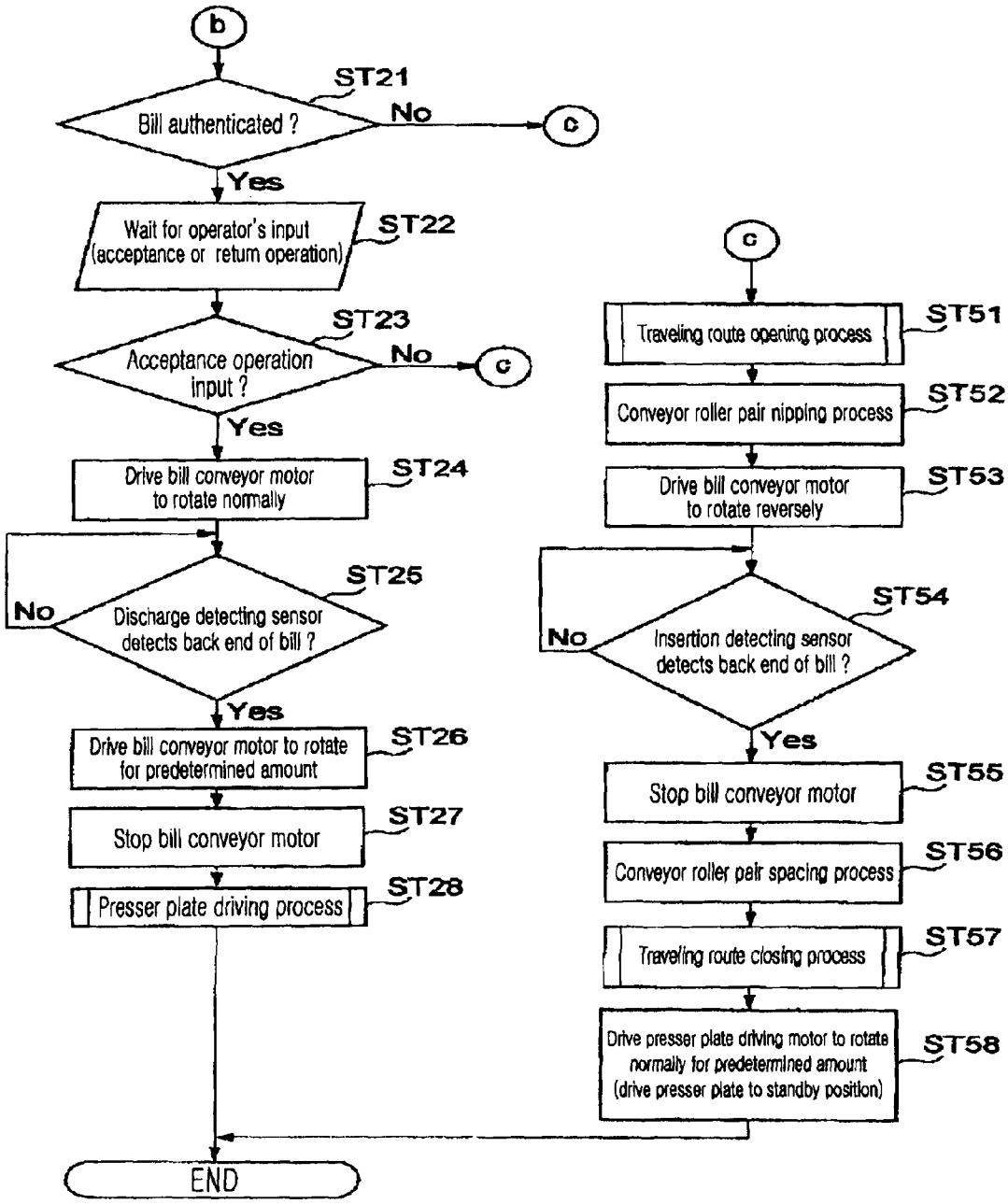
FIG. 18 shows a flowchart (part three) illustrating processing operations for processing the bill in the bill processing apparatus of this embodiment.
Figure 19:
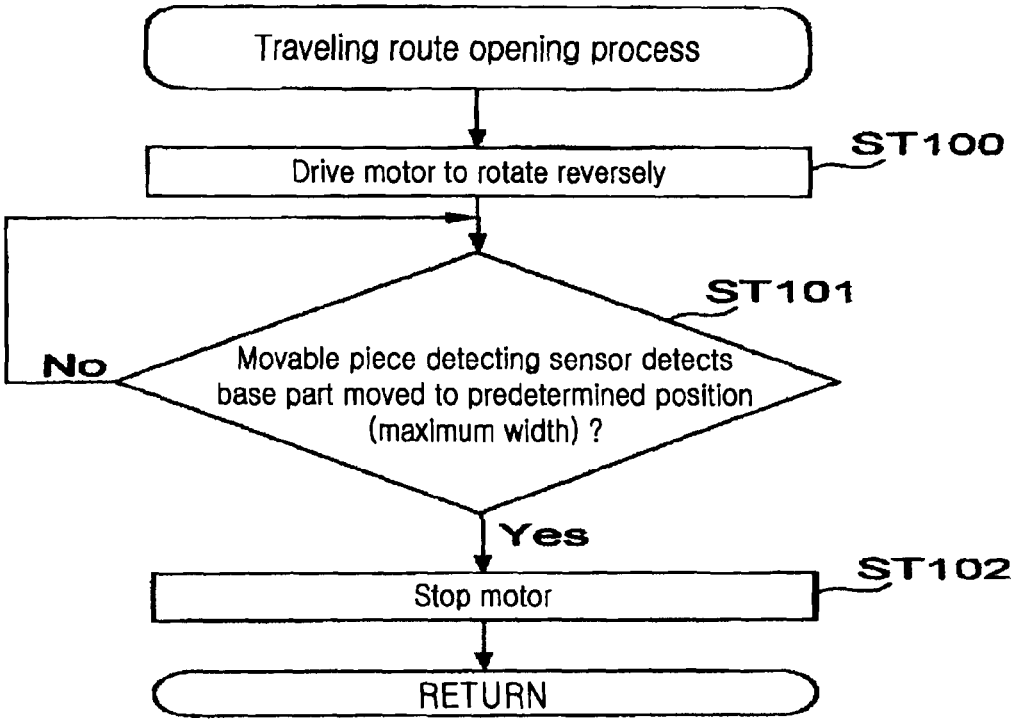
FIG. 19 shows a flowchart illustrating processing operations of a traveling route opening process.

Next, as described above, the control means for controlling the driving of the detecting means 23, the presser plate 115 installed in the bill housing part 100, the bill reading means 8, and the bill conveyance mechanism 6 will be described with reference to FIG. 15.

The control means 200 comprises a control circuit board 200A that controls the operations of the above-described respective drive units, and a CPU (Central Processing Unit) 210 constituting bill identification means, a ROM (Read Only Memory) 212, a RAM (Random Access Memory) 214, and a reference data storage part 216 are mounted on the control circuit board.

In the ROM 212, various types of programs such as operation programs for the respective drive units such as the motor 13 that drives the above-described bill conveyance mechanism, the motor 20 that drives the presser plate, the driving source 70 that drives the conveyor roller 14A to contact/be spaced from the conveyor roller 14B, the motor 40 to drive the skew driving mechanism 10; an authenticity judgment program for the bill read by the bill reading means 8; and permanent data are stored. The CPU 210 generates control signals according to the programs stored in the ROM 212, carries out the input and output of the signals with respect to the respective drive units via an I/O port 220, and controls the driving of the respective drive units.

Further, detection signals from the insertion detecting sensor 7, the movable piece passage detecting sensor 12, the discharge detecting sensor 18, the full detecting sensor 140, and the sensor 172 constituting a part of the detection means 23 capable of detecting the position of the presser plate 115 are to be input to the CPU 210 via the I/O port 220, and the driving of the respective drive units is controlled on the basis of these detection signals.

Further, data and programs used for the operation of the CPU 210 are stored in the RAM 214, and reference data used for the performance of a bill authenticity judgment, for example, various types of data acquired from all the printing areas of the legitimate bill (such as data about contrasting density and data about transmitted light or reflected light when the bill is irradiated with infrared ray) are stored as reference data in the reference data storage part 216. In addition, the reference data is stored in the dedicated reference data storage part 216. However, the data may be stored in the ROM 212.

Then, a bill reading detection sensor (for example, a line sensor) 80 constituting the above-described bill reading means 8 is connected to the CPU 210 via the I/O port 220, and bill reading data read by the bill reading detection sensor 80 is compared with the reference data stored in the reference data storage part 216 such that a bill authenticity judgment process is executed.

In addition, the control means 200 that controls the operation of the bill processing apparatus is implemented on one control circuit board 200A as mentioned above. However, the control means 200 may be implemented in a distributed manner on separate control circuit boards in accordance with respective functions.

Next, the bill processing operation in the bill processing apparatus 1 executed by the control means 200 will be described with reference to the flowcharts of FIGS. 16 to 22.

When an operator inserts a bill into the bill insertion slot 5, the conveyor roller pair (14A and 14B) installed in the vicinity of the bill insertion slot is in a state that the rollers are spaced from each other in an initial stage (refer to ST16 and ST56 to be described later). Further, with respect to the presser plate 115, as shown in FIGS. 10 and 11A, the pair of link members 115*a*, 115*b* driving the presser plate 115 are positioned in the press standby part 108, and the pair of link members 115*a*, 115*b* prevent the bill from being conveyed into the press standby part 108 from the receiving port 103 (refer to ST134 to be described later). That is, in this state, the presser plate 115 is brought into the opening 110A formed between the pair of regulatory members 110 such that the opening 110A is in an occluded state so as to prevent the bill stored in the bill housing part from being drawn out.

Moreover, the pair of movable pieces 10A constituting the skew correction mechanism 10 located on the downstream side of the conveyor roller pair (14A, 14B) are in a state that the pair of movable pieces 10A are moved to leave the minimum open width therebetween (for example, an interval between the pair of movable pieces 10A is 52 mm; refer to ST15 and ST57 to be described later) so as to prevent the bill from being drawn out in the initial stage.

When the above-described pair of conveyor rollers (14A and 14B) are in the initial state, the operator easily insert a wrinkled bill into the bill insertion slot 5. Then, when the insertion detecting sensor 7 detects the insertion of the bill (ST01), the driving motor 20 of the above-described presser plate 115 is driven to rotate reversely for a predetermined amount (ST02) to move the presser plate 115 to the initial position. In this initial position, the press standby part 108 is in an open state (refer to FIGS. 8 and 11B), and the bill can be conveyed into the inside of the bill housing part 100. That is, by driving the motor 20 to rotate reversely for a predetermined amount, the presser plate 115 is driven from the standby position to the initial position via the main body side gear train 21 and the presser plate driving mechanism 120 (the housing part side gear train 124, the rack 122A formed on the movable member 122, and the link members 115*a* and 115*b*). As shown in FIGS. 11A and 11B, the press standby part 108 is opened by the movement of the presser plate 115 such that the bill can be conveyed into the inside of the bill housing part. In addition, at this time, the cam 175 formed on the above-described cam member 175A has the shape to limit the movement of the detecting member 170 as shown in FIGS. 11A and 11B such that the movement of the presser plate 115 is not detected by the sensor 172.

Further, the above-described driving source 70 is driven to move the upper conveyor roller 14A so as to make a contact with the lower conveyor roller 14B. In accordance therewith, the inserted bill is nipped and held therebetween by the pair of conveyor rollers (14A and 14B) (ST03).

Next, a traveling route opening process is conducted (ST04). The opening process is conducted by driving the pair of movable pieces 10A to move in separating directions so as to become apart with each other as the motor 40 for the skew correction mechanism is driven to rotate reversely as shown in the flow chart of FIG. 19 (ST100). At this time, when it is detected that the pair of movable pieces 10A have moved to the predetermined positions (the maximum open width positions) by the movable piece detecting sensor that detects positions of the pair of movable pieces 10A (ST101), the driving operation to rotate the motor 40 reversely is stopped (ST102). This traveling route opening process allows the bill to enter between the pair of movable pieces 10A. In addition, in the previous step of ST04, the bill traveling route 3 is in a closed state by a traveling route closing process (ST15, ST57) to be described later. Thus, the bill traveling route 3 is closed in this way before an insertion of the bill so as to prevent an element such as a line sensor from being broken by, for example, inserting a plate-like member from the bill insertion slot for illicit purposes or the like.

Next, the bill conveyor motor 13 is driven to rotate normally (ST05). The bill is carried into the inside of the apparatus by the conveyor roller pair (14A and 14B), and when the movable piece passage detecting sensor 12 installed on the downstream side from the skew correction mechanism 10 detects the front end of the bill, the bill conveyor motor 13 is stopped (ST06 and ST07). At this time, the bill is located between the pair of movable pieces 10A constituting the skew correction mechanism 10.

Next, the above-described driving source 70 is driven to allow the conveyor roller pair (14A and 14B) holding the bill therebetween to become apart from each other (ST08). At this time, the bill is in a state that no load is applied.

Figure 20:
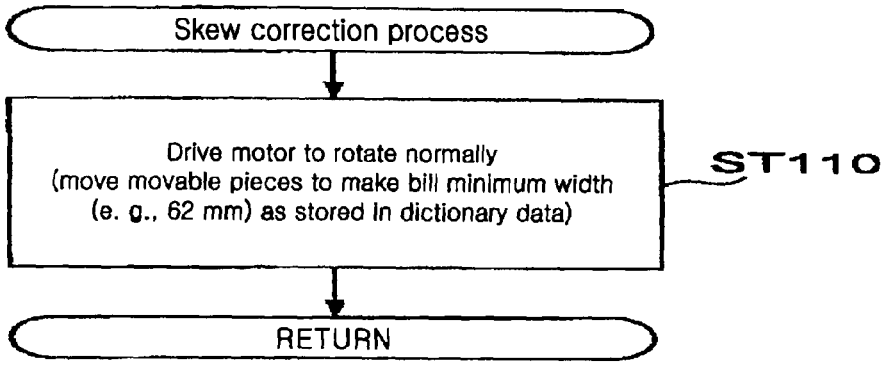
FIG. 20 shows a flowchart illustrating processing operations of a skew correction operating process.

Then, a skew correction operating process is executed as the bill remains in this state (ST09). The skew correction operating process is conducted by driving the motor 40 for the skew correction mechanism to rotate normally to drive the pair of movable pieces 10A to get closer with each other. That is, in this skew correction operating process, as shown in the flowchart of FIG. 20, the motor 40 described above is driven to rotate normally to move the pair of movable pieces 10A in respective directions such that the pair of movable pieces 10A get closer with each other (ST110). The movement of the movable pieces is continued until the interval becomes the minimum width (example; width of 62 mm) of the bill registered in the reference data storage part in the control means, and the skew is corrected by the movable pieces 10A touching both sides of the bill such that the bill may be positioned at the accurate center position.

When the skew correction operating process as described above is completed, a traveling route opening process is subsequently executed (ST10). This process is conducted by moving the pair of movable pieces 10A in separating directions as the above-described motor 40 for the skew correction mechanism is driven to rotate reversely (refer to ST100 to ST102 of FIG. 19).

Next, the above-described driving source 70 is driven to move the upper conveyor roller 14A to contact the lower conveyor roller 14B, and the bill is nipped and held between the pair of conveyor rollers (14A and 14B) (ST11). Thereafter, the bill conveyor motor 13 is driven to rotate normally to carry the bill into the inside of the apparatus, and when the bill passes through the bill reading means 8, a bill reading process is executed (ST12 and ST13).

Figure 21:
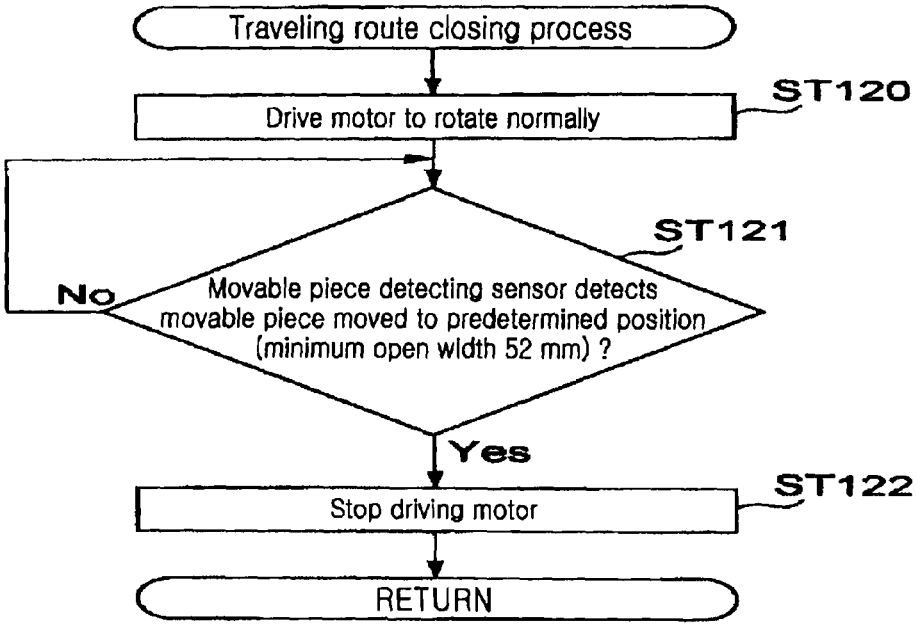
FIG. 21 shows a flowchart illustrating processing operations of a traveling route closing process.

Then, when the bill to be carried passes through the bill reading means 8, and the back end of the bill is detected by the movable piece detecting sensor 12 (ST14), a process for closing the bill traveling route 3 is executed (ST15). In this process, first, as shown in the flowchart of FIG. 21, after the back end of the bill is detected by the movable piece detecting sensor 12, the above-described motor 40 is driven to rotate normally to move the pair of movable pieces 10A in respective directions such that the pair of movable pieces 10A get closer with each other (ST120). Next, when it is sensed by the movable piece detecting sensor that the movable pieces 10A move to the predetermined positions (minimum open width positions: for example, width of 52 mm) (ST121), the driving operation of the normal rotation of the motor 40 is stopped (ST122).

With this traveling route closing process, the pair of movable pieces 10A are moved to the minimum open width positions (width of 52 mm) narrower than the width of any bill allowed to be inserted, thereby effectively preventing the bill from being drawn out. That is, by executing such a bill traveling route closing process, an opening distance between the movable pieces 10A is made shorter than the width of the inserted bill, thereby enabling the effective prevention of an action of drawing-out the bill in the direction toward the insertion slot by the operator for illicit purposes.

In addition, when the movable piece detecting sensor as described above detects the movement of the movable pieces 10A in this state, it may be considered that the operator is committing some fraudulent activities such that a predetermined processes may be executed. For example, a fraudulent manipulated signal (an anomaly sensed signal) may be transmitted to a higher-level apparatus that manages the operations of the bill processing apparatus, or an annunciator lamp may be provided on the bill processing apparatus, and this lamp may flash, or without activating a process for input acceptance (ST22) input by another operator thereafter, a process in which a discharge operation or the like is forcibly carried out may be executed. Or, appropriate processes such as canceling the operation of the bill processing apparatus (for example, a process for stopping the processing, a process for discharging the bill, and the like) and the like may be executed.

Further, in succession to the traveling route closing process described above (ST15), a conveyor roller pair spacing process is executed such that the driving source 70 is driven to make the conveyor roller pair (14A, 14B) having been in a state capable of nipping and holding the bill therebetween separate from each other (ST16). By executing the conveyor roller pair spacing process, even if the operator additionally inserts (double insertion) another bill by mistake, the bill is not subject to a feeding operation by the conveyor roller pair (14A, 14B) and hits front ends of the pair of movable pieces 10A in a closed state according to ST15 such that it is possible to reliably prevent the operation of bill double-insertion.

Along with the bill traveling route closing process as mentioned above, when the bill reading means 8 reads the data up to the back end of the bill, the bill conveyor motor 13 is driven for a predetermined amount and leave the bill stopped at a predetermined position (escrow position; position where the bill is carried toward the downstream by 13 mm from the center position of the bill reading means 8), and at this time, a bill authenticity judgment process is executed by the control means 200 (ST17 to ST20).

In the bill authenticity judgment process at ST20 as described above, when the bill is judged as a legitimate bill (ST21; Yes), an input from the operator is received (ST22). This input corresponds to an acceptance operation in which the operator presses an acceptance button in order to accept provision of services (for example, in the case of a gaming device, an acceptance process accompanied by start of a game), and a return operation in which the operator presses a return button in order to execute a process for returning the inserted bill.

Then, when an operation to accept the provision of various types of services is input (ST23; Yes), the bill conveyor motor 13 is consecutively driven to rotate normally to convey the bill in this state toward the bill housing part 100 (ST24). While the bill is conveyed, the bill conveyor motor 13 is driven to rotate normally until the back end of the bill is detected by the discharge detecting sensor 18 (ST25), and after the back end of the bill is detected by the discharge detecting sensor 18, the bill conveyor motor 13 is driven to rotate normally by the predetermined amount (ST26 and ST27).

The process for driving the bill conveyor motor 13 to rotate normally in ST26 and ST27 corresponds to a driving amount for which the bill is conveyed in the receiving port 103 of the bill housing part 100 from the discharge slot 3*a* on the downstream side of the bill traveling route 3 of the apparatus main body 2 so that the pair of belts 150 contact the surface on both sides of the conveyed-in bill to guide the bill stably to the press standby part 108. That is, by further driving the bill conveyor motor 13 to rotate normally for a predetermined amount after the back end of the bill is detected by the discharge detecting sensor 18, the pair of belts 150 contact the bill conveyed-in and are driven in the bill feeding direction so as to guide the bill in a stable state to the press standby part 108. In this case, the bill is guided along the guide faces 160*a* of the guide members 160 formed along the bill conveying-in direction from the receiving port 103. When the bill is conveyed in the press standby part 108, the bill is to be conveyed to the appropriate pressing position without shifting to either side partly because the pair of belts 150 contact the bill. A pressing process is conducted such that the bill is bent in a bilaterally symmetric manner by the presser plate 115 and passes through the opening 110A between the pair of regulatory members 110.

Then, after the above-described bill conveyor motor 13 is stopped, the process for driving the presser plate 115 is executed (ST28) such that the bill is placed on the placing plate 105.

Figure 22:
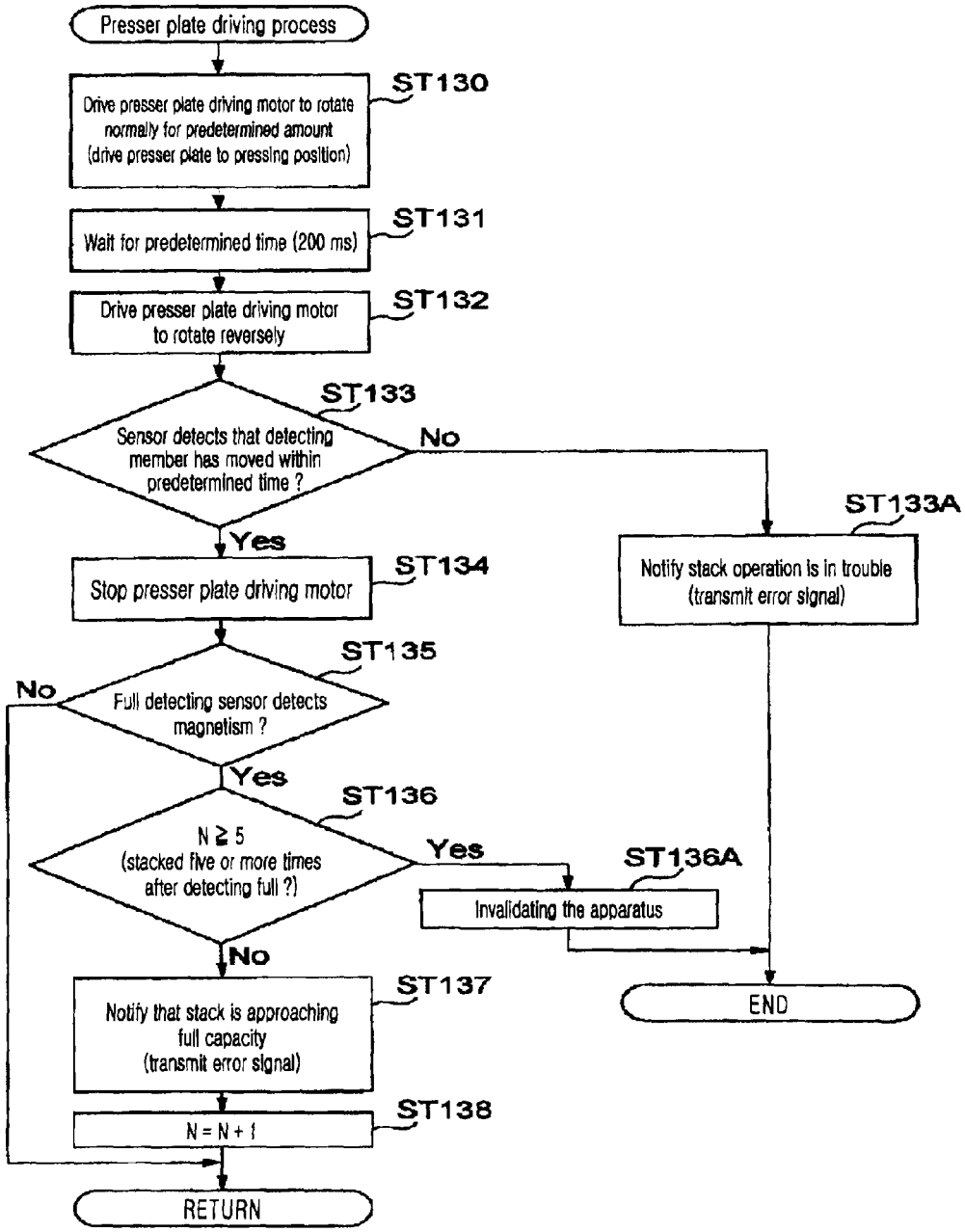
FIG. 22 shows a flowchart illustrating processing operations of a presser plate driving process.

The process for driving the presser plate 115 is executed in accordance with the flowchart as shown in FIG. 22. First, the driving motor 20 of the presser plate 115 is driven to rotate normally for a predetermine amount to move the presser plate 115 staying at the initial position in the above ST02 until it gets to the pressing position (ST130). With respect to the amount of driving to rotate normally the motor 20, if the motor 20 is composed of a DC motor, a predetermined amount of rotation can be set such that pulses are generated by utilizing, for example, an encoder and the number of the pulses is measured. That is, by driving the driving motor 20 to rotate normally for a predetermined amount, the presser plate 115 is moved from the initial position to the pressing position via the main body side gear train 21 and the presser plate driving mechanism 120 (the housing part side gear train 124, the rack 122A formed on the movable member 122, and the link members 115*a* and 115*b*).

According to the movement of the presser plate 115, as shown in FIGS. 8 and 9 (FIGS. 11B and 11C), the bill in the press standby part 108 passes through the opening 110A between the pair of regulatory members 110 so as to be deflected in a U-shape in a laterally symmetrical manner, and the bill is finally pressed onto the placing plate 105. In this case, since the bill is conveyed to the appropriate pressing position without leaning to either side by the pair of belts 150 as described above, even if the presser plate 115 is moved, the bill is placed on the placing plate 105 stably without jamming or the like between the presser plate 115 and the pair of regulatory members 110.

In addition, since the cam member 175A described above is driven to rotate in a clockwise direction in FIG. 11B, the engaging state of the cam touching part 176*b* of the cam follower 176 engaged with the cam 175 is released, and the detecting member 170 is depressed downward by the biasing force of the biasing member 171 (the cam follower 176 is made to rotate in a clockwise direction around the axis 176*a* serving as a fulcrum axis. Since the detecting part 170*a* formed on the end is demounted from the sensor 172 by the downward movement of the detecting member 170, it is detected by the sensor 172 that the presser plate 115 has moved to the pressing position (FIG. 11C)

When the presser plate 115 is moved to the pressing position, the presser plate 115 is processed to wait (ST131) for a predetermined time (200 ms) at the pressing position so as to place the bill stably on the placing plate 105, and thereafter, the driving motor 20 of the presser plate 115 is driven to rotate reversely (ST132). As the motor 20 is driven to rotate reversely, the cam member 175A described above is driven to rotate in a counterclockwise direction in FIG. 11C and FIG. 13, and when the presser plate 115 is moved to the standby position shown in FIG. 11A, the cam 175 engages with the cam touching part 176*b* of the cam follower 176, and the cam follower 176 is made to rotate in a counterclockwise direction around the axis 176*a* serving as a fulcrum axis. In this case, the detecting member 170 described above is pushed up by the detecting member touching part 176*c* of the cam follower 176, and the detecting part 170*a* formed on the end is detected by the sensor 172 (FIG. 11A). That is, when it is detected by the sensor 172 that the presser plate 115 has moved from the pressing position to the standby position, the driving of the motor 20 is stopped, and the presser plate 115 is stopped at the standby position (ST133: Yes, ST134). As described above, the bill cannot be drawn out in this standby position.

In addition, if the sensor 172 does not detect that the presser plate 115 has moved from the pressing position to the standby position within a predetermined time, it is considered that something is wrong with the stack operation, and the signal expressing that something is wrong with the stack operation (an error signal) is transmitted to an external device, annunciation means, or the like (ST133; No, ST133A).

Then, after the presser plate 115 is moved from the pressing position to the standby position, in a case where the full detecting sensor 140 described above detects magnetism from the magnet provided to the rear surface of the placing plate 105 (ST135; Yes), it is informed that the bill housing part 100 approaches to the limit capacity (ST136: No, ST137). This informing is to be repeated under the condition of a predetermined number of times (four times in this embodiment) or less after the full detecting sensor 140 detects the thereby enabling an administrator to exchange the bill housing part 100 before the bill housing part 100 is full with the bills.

Further, after the full detecting sensor 140 detects the magnetism, when it is detected that five or more times the bill stack operation is repeated without exchanging the bill housing part 100 (ST136; Yes), a process of invalidating the apparatus is executed in order for bills not to be further inserted therein (ST136A). With respect to this invalidation process, for example, a process of stopping driving the bill conveyor mechanism described above may be performed in order not to convey the bill inside even if a user inserts a bill into the bill insertion slot.

In the process of ST21, when the bill is judged as a non-legitimate bill or the operator presses the return button (ST23; No), a traveling route opening process is executed (ST51, refer to ST100 to ST102 of FIG. 19). After that, the bill conveyor motor 13 is driven to rotate reversely and the conveyor roller pair (14A, 14B) are brought in contact with each other such that the bill waiting at the escrow position is conveyed toward the bill insertion slot 5 (ST52 and ST53). Then, when the insertion detecting sensor 7 senses the back end of the bill to be returned toward the bill insertion slot 5, the driving to reversely rotate the bill conveyor motor 13 is stopped, and above-described driving source 70 is driven to make the conveyor roller pair (14A and 14B) in a state of nipping and holding the bill therebetween separate from each other (ST54 to ST56). Then, the traveling route closing process is executed and process is completed (refer to ST57 and ST120 to ST122 of FIG. 19).

Further, as shown in FIG. 14, since the detecting member 170 described above is released from the engagement relationship with the cam follower 176 when the above-described bill housing part 100 is demounted from the frame 2A (at this time, the presser plate 115 is in the standby position), the detecting member 170 is moved toward the bill housing part by the biasing member 171. The movement of the detecting member 170, that is, demounting the bill housing part 100 from the frame 2A is detected by the sensor 172.

Then, by demounting the bill housing part 100, the movable member 122 on which the rack 122A is formed is moved to the initial position as shown in FIG. 11B by the biasing spring 122B as shown in FIG. 12A. As a result, when the bill housing part 100 is mounted to the frame 2A of the apparatus main body 2, the detecting member touching part 176*c* formed on the cam follower 176 as shown in FIG. 13 touches the guide face 170*d* of the detecting member 170, to push up the detecting member 170 against the biasing force of the biasing member 171 according to the shape of the guide face 170*d*. The movement of pushing up the detecting member 170, that is, mounting the bill housing part 100 to the frame 2A is detected by the sensor 172. In addition, in this case, as the detecting member touching part 176*c* of the cam follower touches the guide face 170*d* formed on the detecting member 170 so as to move the detecting member 170 to the position detectable by the sensor 172, it is possible to smoothly mount the bill housing part 100 to the frame 2A.

According to the bill processing apparatus having the above-described configuration, the detecting member 170 moves as the presser plate 115 that presses the bill is moved from the initial position to the pressing position, and the movement of the detecting member is detected by the sensor 172 such that the position of the presser plate 115 can be detected. Further, when the bill housing part 100 is demounted from the frame 2A, the detecting member 170 is disengaged from the cam 175 so as to be moved by the moving mechanism 180, thereby enabling the same sensor 172 to detect the movement of the detecting member 170. In this case, the detection of the presser plate 115 at the pressing position and the detection of demounting the bill housing part 100 from the frame 2A are both carried out by the sensor 172 based on the movement of the detecting member 170. However, the former detection is carried out by detecting a temporary movement of the presser plate 115 driven at the time of housing the bill such that the same sensor 172 may be able to perform both detections by setting a threshold time. Therefore, the structure can be simplified so as to make it possible to inexpensively detect the presence or absence of mounting and demounting the bill housing part 100 and a position of the presser plate 115.

Further, in the above-described configuration, as shown in FIGS. 11C and 11A, when the presser plate 115 is moved from the pressing position to the standby position, the movement of the detecting member 170 is detected by the sensor 172. Therefore, it is not necessary to restore the presser plate 115 to the original position where the sensor can detect it as required conventionally. Therefore, it is not necessary to move the presser plate 115 from the pressing position to the initial position where the plate is detectable by the sensor and thereafter to move the presser plate 115 to the standby position as required in the conventional art when the presser plate 115 is restored from the pressing position to the standby position. Therefore, the operation control is simplified.

Further, when bills are allowed to be conveyed to the inside of the bill housing part 100, it suffices to move the presser plate 115 from the standby position to the initial position. At that time, because the detecting member 170 is limited in its movement by the cam, the detection thereof by the sensor 172 is not carried out, which makes unnecessary control for the sensor redundant.

As mentioned above, the embodiment of the present invention is described. However, the present invention is not limited to the above-described embodiment, and various modifications of the present invention can be implemented. In the present invention, it is configured that the movement of the presser plate to the pressing position and the removal of the bill housing part from the apparatus main body can be detected by one sensor and it is also possible to modify the configuration of the detecting member and the moving mechanism accordingly.

Further, the driving source that drives the various types of driving members as described above or the power transmission mechanism from the driving source has been merely disclosed as one example, and it is possible to modify such an example accordingly.

The present invention can be incorporated into various types of apparatuses to provide products and services by inserting a bill thereinto, for example. It is also possible to apply it to a processing device to process a paper sheet such as a coupon ticket, not limited to, but including the bill.

According to a paper sheet processing apparatus having the above-described configuration, when the pressing plate that presses the paper sheet is moved toward the pressing position for housing the paper sheet, the detecting member is moved along with the movement of the presser plate, and it becomes possible to detect the position of the presser plate by detecting the detecting member. Further, when the paper sheet housing part is removed from the frame, the detecting member is moved by the moving mechanism such that the same sensor detects the detecting member, thereby enabling the detection of mounting and dismounting the paper sheet housing part to and from the frame. In this case, the detection of the presser plate at the pressing position and the detection of demounting the paper sheet housing part from the frame are both carried out by the sensor based on the movement of the detecting member. The former detection is carried out by detecting a temporary movement of the presser plate driven at the time of housing the paper sheet such that the same sensor 172 may be able to perform both detections. Therefore, the structure can be simplified so as to make it possible to inexpensively detect the presence or absence of mounting and demounting the paper sheet housing part and a position of the presser plate.

Further, the presser plate is capable of moving to the standby position where the paper sheet is prevented from being conveyed into the paper sheet housing part between the pressing position and the home position. The moving mechanism comprises a cam to prevent the detecting member from moving. The cam has a shape to cause the detecting member to move when the presser plate is moved between the pressing position and the standby position and to prevent the detecting member from moving when the presser plate is moved between the standby position and the home position.

According to such a configuration, when the presser plate is moved between the standby position and the pressing position, the movement of the detecting member is detected by the sensor, and when the presser plate is moved between the standby position and the home position, the detecting member does not move, and therefore, the detection thereof by the sensor is not carried out.

In the conventional art described above, when the presser plate is returned from the pressing position to the standby position, it is necessary to move the presser plate from the pressing position to the home position where detection can be made by the sensor. However, in the invention of claim 2, the presser plate is moved from the pressing position to the standby position such that the detecting member moves, which is detected by the sensor, such that it is not necessary to return the presser plate to the home position. Further, when the paper sheet is allowed to be conveyed into the inside of the paper sheet housing part, it suffices to move the presser plate for a predetermined amount from the standby position to the home position. In such a case, the movement of the detecting member is restricted by the cam, the detection thereof by the sensor is not carried out such that the control of the sensor, which is meaningless, becomes unnecessary.

Further, the moving mechanism comprises a transmission member being installed between the detecting member and the cam and including a touching part to contact the detecting member, and the detecting member comprises a guide face that engages with the touching part of the transmission member to move the detecting member to a position where detection can be carried out by the sensor when the paper sheet housing part is mounted to the frame.

According to such a configuration, when the paper sheet housing part is mounted to the frame, the touching part of the transmission member contacts the guide face formed on the detecting member to move the detecting member to the position where detection can be carried out by the sensor. Therefore, it becomes possible to smoothly mount the paper sheet housing part to the frame.

Further, the detecting member is biased so as to contact the touching part of the transmission member, and the transmission member is supported rotatably and comprises a rotation regulating part that regulates rotation by the guide face of the detecting member when the presser plate is moved to the pressing position.

According to such a configuration, when the presser plate is moved to the pressing position, the transmission member supported rotatably can be kept in a stable condition because the rotation of the rotation regulating part is regulated by the guide face of the detecting member such that the movement of the detecting member is reliably detected by the sensor.

According to the present invention, a paper sheet processing apparatus having a simplified structure can be obtained so as to become capable of inexpensively detecting the presence or absence of mounting and demounting the paper sheet housing part and a position of a presser plate.

What is claimed is:

1. A paper sheet processing apparatus supported by a frame, comprising:

a paper sheet housing part capable of housing a paper sheet and being mountable to and demountable from the frame;

a presser plate to be moved in the paper sheet housing part between a pressing position where the paper sheet is pushed and a home position where the paper sheet is allowed to be conveyed inside the paper sheet housing part;

a detecting member being movable in synchronization with a movement of the presser plate;

a sensor to detect a movement of the detecting member; and a moving mechanism to move the detecting member when the presser plate is moved to the pressing position as well as when the paper sheet housing part is demounted from the frame, wherein: the moving mechanism comprises:

a cam to rotate in response to a movement of the presser plate; and a transmission member including a touching part to cause the detecting member to be moved by contacting the detecting member in accordance with a rotation of the cam, and the cam comprises a shape to limit the movement of the detecting member when the presser plate is moved from the home position to the standby position where the paper sheet is prevented from being conveyed inside the paper sheet housing part.

2. The paper sheet processing apparatus according to claim 1, wherein:

the detecting member comprises a guide face to guide the detecting member to a predetermined position by contacting the touching part when the paper sheet housing part is mounted; and the transmission member comprises a rotation regulating part to regulate rotation of the transmission member by contacting the guide face when the presser plate is moved to the pressing position.

3. The paper sheet processing apparatus according to claim 2, comprising:

a counter to count a detection of the detecting member by the sensor; and a full detecting sensor to detect the paper sheet housing part to be full, wherein an abnormal signal can be transmitted after the counter counts a predetermined number from transmission of a full signal of the full detecting sensor.

4. A paper sheet processing apparatus supported by a frame, comprising:

a paper sheet housing part capable of housing a paper sheet and being mountable to and demountable from the frame;

a presser plate to be moved in the paper sheet housing part between a pressing position where the paper sheet is pushed and a home position where the paper sheet is allowed to be conveyed inside the paper sheet housing part;

a detecting member being movable in synchronization with a movement of the presser plate;

a sensor to detect a movement of the detecting member; and a moving mechanism to move the detecting member when the presser plate is moved to the pressing position as well as when the paper sheet housing part is demounted from the frame, wherein:

when the paper sheet housing part is demounted, the presser plate and the moving mechanism are removed along with the paper sheet housing part and the detecting member and the sensor remain on a frame side, the moving mechanism comprises:

a cam to rotate in response to a movement of the presser plate; and a transmission member including a touching part to cause the detecting member to be moved by contacting the detecting member in accordance with a rotation of the cam, and the cam comprises a shape to limit the movement of the detecting member when the presser plate is moved from the home position to the standby position where the paper sheet is prevented from being conveyed inside the paper sheet housing part.

5. The paper sheet processing apparatus according to claim 4, wherein:

the detecting member comprises a guide face to guide the detecting member to a predetermined position by contacting the touching part when the paper sheet housing part is mounted; and the transmission member comprises a rotation regulating part to regulate rotation of the transmission member by contacting the guide face when the presser plate is moved to the pressing position.

6. The paper sheet processing apparatus according to claim 5, comprising:

a counter to count a detection of the detecting member by the sensor; and a full detecting sensor to detect the paper sheet housing part to be full, wherein an abnormal signal can be transmitted after the counter counts a predetermined number from transmission of a full signal of the full detecting sensor.

* * * * *